US010844680B2

(12) United States Patent
Ross et al.

(10) Patent No.: US 10,844,680 B2
(45) Date of Patent: Nov. 24, 2020

(54) APPARATUS AND METHOD TO EXPEL FLUID

(71) Applicant: METROL TECHNOLOGY LIMITED, Aberdeen (GB)

(72) Inventors: Shaun Compton Ross, Aberdeenshire (GB); Leslie David Jarvis, Aberdeenshire (GB)

(73) Assignee: METROL TECHNOLOGY LIMITED (GB)

( * ) Notice: Subject to any disclaimer, the term of this patent is extended or adjusted under 35 U.S.C. 154(b) by 0 days.

(21) Appl. No.: 16/302,650

(22) PCT Filed: May 26, 2017

(86) PCT No.: PCT/GB2017/051518
§ 371 (c)(1),
(2) Date: Nov. 18, 2018

(87) PCT Pub. No.: WO2017/203288
PCT Pub. Date: Nov. 30, 2017

(65) Prior Publication Data

US 2019/0128081 A1 May 2, 2019

(30) Foreign Application Priority Data

May 26, 2016 (GB) ..... 1609287.6

(51) Int. Cl.
*E21B 27/02* (2006.01)
*E21B 33/124* (2006.01)
(Continued)

(52) U.S. Cl.
CPC ..... *E21B 27/02* (2013.01); *E21B 33/124* (2013.01); *E21B 34/066* (2013.01); *E21B 37/06* (2013.01);
(Continued)

(58) Field of Classification Search
CPC ..... E21B 27/02; E21B 33/124; E21B 34/066
See application file for complete search history.

(56) References Cited

U.S. PATENT DOCUMENTS 2,619,180 A 11/1952 Smith et al.
2,994,378 A * 8/1961 Reistle, Jr. ..... E21B 27/02 166/72
(Continued)

FOREIGN PATENT DOCUMENTS

CN 203531888 4/2014
DE 102010014415 12/2010
(Continued)

OTHER PUBLICATIONS

UKIPO Search Report dated Dec. 20, 2016 in corresponding GB Application No. 1609287.6.
(Continued)

*Primary Examiner* — Matthew R Buck
(74) *Attorney, Agent, or Firm* — Womble Bond Dickinson (US) LLP

(57) ABSTRACT

A downhole apparatus and method for expelling fluid which comprises a container defining a void which is separated into three separate sections by a floating piston and control member, each having a dynamic seal. A portion of the container defining one of the void sections has a different cross-sectional area than the portion of the container defining another void section. In use, a fluid to be expelled is provided in one void section, and a reduced pressure (compared to the well) is sealed in another void section. The apparatus also comprises a wireless electromagnetic or acoustic receiver. When a signal is received by the wireless receiver to activate the apparatus, a valve or other mechanism maybe activated to release the floating piston and connected control member such that the lower pressure void and differing cross-sectional areas of the container drives
(Continued)

and expels fluid out of the apparatus. The apparatus thus allows fluid to be expelled from the container using a reduced rather than an elevated pressure in the container. Apparatus with reduced pressures can be safer to use compared to those with elevated pressures. The apparatus may be used to deliver chemicals such as a breaker fluid, tracer, acid treatment, chemical barrier or precursors to a chemical barrier into a well or reservoir.

20 Claims, 7 Drawing Sheets

(51) Int. Cl.

| | |
|---|---|
| ***E21B 34/06*** | (2006.01) |
| *E21B 47/07* | (2012.01) |
| *E21B 47/113* | (2012.01) |
| *E21B 37/06* | (2006.01) |
| *E21B 43/26* | (2006.01) |
| *E21B 47/06* | (2012.01) |
| *E21B 47/18* | (2012.01) |

(52) U.S. Cl.
CPC ..... *E21B 43/26* (2013.01); *E21B 47/06* (2013.01); *E21B 47/07* (2020.05); *E21B 47/113* (2020.05); *E21B 47/18* (2013.01)

(56) References Cited

U.S. PATENT DOCUMENTS

| | | | |
|---|---|---|---|
| 3,020,961 | A | 2/1962 | Orr |
| 5,394,141 | A | 2/1995 | Soulier |
| 5,576,703 | A | 11/1996 | MacLeod et al. |
| 6,173,772 | B1 | 1/2001 | Vaynshteyn |
| 6,357,525 | B1 | 3/2002 | Langseth et al. |
| 6,494,616 | B1 | 12/2002 | Tokhtuev et al. |
| 8,215,164 | B1 | 7/2012 | Hussain et al. |
| 2002/0020535 | A1 | 2/2002 | Johnson et al. |
| 2002/0066563 | A1 | 6/2002 | Langseth et al. |
| 2003/0056952 | A1 | 3/2003 | Stegemeier et al. |
| 2004/0104029 | A1 | 6/2004 | Martin |
| 2005/0077086 | A1 | 4/2005 | Vise |
| 2006/0225881 | A1 | 10/2006 | O'Shaughnessy et al. |
| 2007/0162235 | A1 | 7/2007 | Zhan et al. |
| 2007/0236215 | A1 | 10/2007 | Innes et al. |
| 2008/0066536 | A1 | 3/2008 | Goodwin et al. |
| 2008/0156482 | A1 | 7/2008 | Gubar et al. |
| 2009/0229813 | A1 | 9/2009 | Brink et al. |
| 2010/0155054 | A1* | 6/2010 | Innes ..... E21B 27/02 166/165 |
| 2011/0158050 | A1 | 6/2011 | Merino et al. |
| 2011/0174487 | A1 | 7/2011 | Burleson et al. |
| 2011/0303409 | A1 | 12/2011 | Harrigan et al. |
| 2012/0085540 | A1 | 4/2012 | Heijnen |
| 2013/0075109 | A1 | 3/2013 | Frisby et al. |
| 2013/0098628 | A1 | 4/2013 | Van Wijk |
| 2013/0133883 | A1 | 5/2013 | Hill |
| 2013/0299165 | A1 | 11/2013 | Crow |
| 2014/0041873 | A1 | 2/2014 | Lovik |
| 2014/0311736 | A1 | 10/2014 | Pipchuk et al. |
| 2014/0326465 | A1 | 11/2014 | Carisella |
| 2015/0159480 | A1 | 6/2015 | Kalyanaraman et al. |
| 2015/0233773 | A1 | 8/2015 | Sale et al. |
| 2015/0292288 | A1 | 10/2015 | Kasperski et al. |
| 2015/0315895 | A1 | 11/2015 | Patel et al. |
| 2016/0123133 | A1 | 5/2016 | Leeflang et al. |

FOREIGN PATENT DOCUMENTS

| | | |
|---|---|---|
| EP | 2192262 | 6/2010 |
| EP | 2886790 | 6/2015 |
| GB | 2522272 | 7/2015 |
| WO | 200301169 | 1/2003 |
| WO | 2003098176 | 11/2003 |
| WO | 2014022384 | 2/2014 |
| WO | 2014120988 | 8/2014 |
| WO | 2017203285 | 11/2017 |
| WO | 2017203286 | 11/2017 |
| WO | 2017203287 | 11/2017 |
| WO | 2017203290 | 11/2017 |
| WO | 2017203291 | 11/2017 |
| WO | 2017203292 | 11/2017 |
| WO | 2017203293 | 11/2017 |
| WO | 2017203294 | 11/2017 |
| WO | 2017203295 | 11/2017 |
| WO | 2017203296 | 11/2017 |

OTHER PUBLICATIONS

International Search Report for PCT/GB2017/051518, dated Jul. 26, 2017.
Schlumberger: "WellWatcher Flux, Multizonal reservoir monitoring system", 2016.
Copending International Application No. PCT/GB2017/051515 filed May 26, 2017.
Copending International Application No. PCT/GB2017/051516 filed May 26, 2017.
Copending International Application No. PCT/GB2017/051517 filed May 26, 2017.
Copending International Application No. PCT/GB2017/051520 filed May 26, 2017.
Copending International Application No. PCT/GB2017/051521 filed May 26, 2017.
Copending International Application No. PCT/GB2017/051522 filed May 26, 2017.
Copending International Application No. PCT/GB2017/051523 filed May 26, 2017.
Copending International Application No. PCT/GB2017/051524 filed May 26, 2017.
Copending International Application No. PCT/GB2017/051525 filed May 26, 2017.
Copending International Application No. PCT/GB2017/051526 filed May 26, 2017.

* cited by examiner

APPARATUS AND METHOD TO EXPEL FLUID

CROSS REFERENCE TO RELATED APPLICATIONS

This application is a 35 U.S.C. 371 National Stage of International Application No. PCT/GB2017/051518, titled "APPARATUS AND METHOD TO EXPEL FLUID", filed May 26, 2017, which claims priority to GB Application No. 1609287.6, titled "APPARATUS AND METHOD TO EXPEL FLUID", filed May 26, 2016, all of which are incorporated by reference herein in their entirety.

This invention relates to an apparatus and method for expelling fluid in a borehole.

Boreholes are commonly drilled for a variety of reasons in the oil and gas industry, not least to function as wells to recover hydrocarbons, but also as test wells, observation wells or injection wells.

On occasion, it may be necessary to deploy fluid into the well. For example, an acid treatment may be conducted where a chemical, often hydrochloric acid based, is deployed in a well in order to remove or mitigate blockages or potential blockages, such as scale, in the well. This can also be used to treat perforations in the well.

In order to deploy the acid treatment, fluid may be pumped from surface through the tubing. However this may not accurately direct the fluid to the specific area of the well or formation required.

In order to more accurately deploy fluid into a required area of the well, coiled tubing may be used. A 2" diameter coiled tube, for example, can be deployed into the well. The acid treatment is then pumped down the tube and exits into the well at the appropriate area.

Whilst generally satisfactory, the inventors of the present invention have noted that deploying fluids in such a manner can be capital intensive requiring considerable rig time and large volumes of fluid. When using coiled tubing, many thousands of feet is often required (depending on the well depth). Moreover it is a time-consuming process to launch the coiled tubing, deploy the fluid, and then recover the coiled tubing. Sometimes coiled tubing cannot access parts of the well due to the configuration of the bottom hole assembly, or the depth or deviation of the well, and so may not be able to deploy the fluid to the particular area intended.

A number of other fluids may be deployed in a well, such as a tracer or breaker fluid.

The inventors of the present invention have sought to mitigate one or more of the problems of the prior art.

According to a first aspect of the present invention, there is provided a downhole apparatus for expelling fluid comprising:

- a container defining a void having a volume of at least 1 litre;
- a floating piston having a first dynamic seal and adapted to move within the container;
  - a first portion of the container in contact with the first dynamic seal with a first cross-sectional area, and a second portion of the container in contact with a second dynamic seal defining a second, smaller, cross-sectional area; said first and second cross-sectional areas being in planes substantially parallel to a main plane of the floating piston;
- the first dynamic seal being between the floating piston and said first portion of the container, such that a first section of the void on one side of the floating piston is isolated from a second section of the void on a second opposite side of the floating piston;
- a control member abutting with the floating piston on said second side, such that the control member moves with the floating piston and is received within the second cross-sectional area defined by the second dynamic seal;
- the second dynamic seal being between the control member and said second portion of the container, such that said second section of the void, being on one side of the second dynamic seal, is isolated from a third section of the void, on an opposite side of the second dynamic seal;
- a first port in the container between the first section of the void and an outside of the container;
- a second port in the container between at least one of the second and third sections of the void and an outside of the container, for expelling fluid therefrom in use;
- an electronic control mechanism comprising an electronic communication device configured to receive a control signal for activating a piston control device; wherein the electronic communication device is a wireless communication device and comprises at least one of an acoustic communication device and an electromagnetic communication device;
- the piston control device operable to directly or indirectly control movement of the piston, and comprising at least one of:
  - (i) a controllable mechanical valve assembly having a valve member adapted to move in response to a signal received from the electronic communication device to selectively allow or resist fluid passage via the first and/or second port; and,
  - (ii) a controllable latch mechanism.

The apparatus can surprisingly be provided with a pressure lower than the pressure in a surrounding portion of a well, in order to expel fluids, rather than requiring the apparatus to have a greater pressure than the surrounding portion of the well to expel the fluids.

When the piston control device is activated, the apparatus may be used to deliver fluids to a well or formation. This can include well/reservoir treatment such as acid treatment, and can obviate the need to run coiled tubing or pump from the surface.

Optionally a mechanical valve assembly is provided at the second port configured to resist fluid flow through the second port in a closed position and allow fluid flow through the second port in an open position. This mechanical valve assembly may be a check valve or may be controllable. In the latter case the mechanical valve assembly at the second port is typically part of the piston control device, that is, it is the controllable valve assembly according to the present invention. Optionally, a check valve may also be provided at the second port.

The mechanical valve assembly may be part of a pump. The pump (and integrated valve(s)) can also regulate fluid rate through one of the ports, normally the second port.

In alternative embodiments, a latch mechanism may control movement of the piston or the controllable valve assembly may be provided at the first port or indeed within the body of the apparatus, away from the ports.

The check valve may be configured to move when exposed to a pre-determined pressure differential, following activation of the piston control device to activate the latch mechanism or a separate controllable valve assembly.

The control member, optionally the rod, may be attached to the floating piston. The control member and floating piston may be integrally formed as a single member.

Optionally the control member comprises a rod.

The valve at the second port, when included, can isolate the fluid expelling section (which can be the second or third section depending on the particular embodiment) in a closed position and allow fluid flow in an open position.

For certain embodiments, a control chamber and a dump chamber are provided. The controllable valve (or a latch) controls movement of fluid from the control chamber to the dump chamber. Movement of the piston is in turn controlled by the presence of fluid in the control chamber. For example a further control member can extend from the floating piston into the control chamber.

The first and second cross-sectional areas are preferably in planes parallel to a main plane of the floating piston, though the apparatus can still function if it is not exactly parallel. Thus "substantially parallel" in this context means +/−20° from parallel.

For certain embodiments, the second port may be between the second section of the void and the outside of the container. In other embodiments, the second port is between the third section of the void and the outside of the container.

Other Valve Options

The mechanical valve assembly normally comprises a valve member. Thus normally in the closed position the valve member seals the container from the surrounding portion of the well in use and normally in the open position the valve member allows fluid passage between the container and the surrounding portion of the well.

The valve member of the controllable valve assembly can be driven by the electronic control mechanism electro-mechanically or electro-hydraulically via porting.

In the open position, pressure and fluid communication may be allowed between a portion of the container and the surrounding portion of the well in use.

The second port may comprise a tube with a plurality of openings. The openings, for example at least three, may be spaced apart from each other in the same direction as the well, for example in a direction substantially parallel to the well, or in a spiral shape, the shape having an axis also generally parallel to the well. The tube may be a small diameter tube (e.g. ¼-¾" outer diameter), which may extend over the communication paths. A rotating inner/outer sleeve or other means may be used to selectively open or close the openings.

There may be a plurality of valve members, optionally controlling ports of different sizes or different themselves. Each different valve member may be independently controlled. Each different valve member may be independently controlled or two or more groups of openings may be controlled by separate valves. For example, groups of openings may be provided on a separate tube, each group being controlled by a valve. The method may then direct the fluid to a particular area.

One valve member (for example a smaller one) may be opened, and the pressure change monitored, using information from a pressure gauge inside or outside of the apparatus, the second valve member (for example a larger one) may be opened, for example at an optimum time, and/or to an optimum extent based on information received such as from a pressure gauge.

The apparatus may comprise a choke.

The choke may be integrated with the mechanical valve assembly or it may be in a flowpath comprising the port and the mechanical valve assembly.

The opening of the valve member may provide a cross-sectional area for fluid exit, which is at least 0.01 $cm^2$, optionally at least 0.1 $cm^2$, more optionally at least 1 $cm^2$.

The opening of the valve member may provide a cross-sectional area for fluid exit is at most 150 $cm^2$ or may be at most 25 $cm^2$, or at most 5 $cm^2$, optionally at most 2 $cm^2$.

The valve member may function as a choke. Where a plurality of valve members are provided, multiple different sizes of chokes may be provided. Thus, for certain embodiments, the mechanical valve assembly comprises a variable valve member, which itself can function as a choke and indeed it can be varied in situ (that is, in the well). For example, a choke disk may be used, which may be rotatably mounted with different sizes of apertures to provide a variable choking means.

The valve member may have multiple positions and can move from a closed to an open position, or may have intermediate positions therebetween. More generally, the valve member may move again to the position in which it started, or to a further position, which may be a further open or further closed or partially open/closed position. This is normally in response to a further control signal being received by the electronic communication device (or this may be an instruction in the original signal). Optionally therefore the valve member can move again to resist fluid exit from the container. For example, flow rate can be stopped or started again (optionally before pressure between the container and the well has balanced) or changed, and optionally this may be part-controlled in response to a parameter or time delay.

The mechanical valve assembly normally has an inlet, a valve seat and a sealing mechanism. The seat and sealing mechanism may comprise a single component (e.g. pinch valve, or mechanically ruptured disc). Actuation means include spring, pressure (e.g. stored, pumped, well), solenoids, lead screws/gears, and motors.

Suitable mechanical valve assemblies may be selected from the group consisting of: gate valves, ball valves, plug valves, regulating valves, cylindrical valves, piston valves, solenoid valves, diaphragm valves, disc valves, needle valves, pinch valves, spool valves, and sliding or rotating sleeves.

More preferred for the mechanical valve assembly of the present invention is a valve assembly which may be selected from the group consisting of gate valves, ball valves, plug valves, regulating valves, cylindrical valves, piston valves, solenoid valves, disc valves, needle valves, and sliding or rotating sleeves.

In particular, piston, needle and sleeve valve assemblies are especially preferred.

The valve assembly may incorporate a spring mechanism such that in one open position it functions as a variable pressure release valve.

The valve member may be actuated by at least one of a (i) motor & gear, (ii) spring, (iii) pressure differential, (iv) solenoid and (v) lead screw.

The mechanical valve assembly may be at one end of the apparatus. However it may be in its central body. One may be provided at each end.

The piston control device may be configured to move the valve member in response to the control signal when a certain condition is met, e.g. when a certain pressure is reached or after a time delay. Thus the control signal causing the response of moving the valve member, may be conditional on certain parameters, and different control signals can be sent depending on suitable parameters for the particular well conditions.

Container Options

The apparatus may be elongate in shape. It may be in the form of a pipe. It is normally cylindrical in shape.

References herein to 'casing' includes 'liner' unless stated otherwise.

Whilst the size of the container can vary, depending on the nature of the well in which it will be used, typically the container may have a volume of at least 5 litres (l), optionally at least 10 l or optionally at least 50 l. The container may have a volume of at most 500 l, normally at most 200 l, optionally at most 100 l.

The apparatus may be configured to expel at least 1 litre, optionally at least 5 litres, optionally at least 10 litres, more optionally at least 50 l of fluid from the container to an outside thereof.

Thus the apparatus may comprise a pipe/tubular (or a sub in part of a pipe/tubular) housing the container and other components or indeed the container may be made up of tubulars, such as tubing, or drill pipe joined together. The tubulars may comprise joints each with a length of from 3 m to 14 m, generally 8 m to 12 m, and nominal external diameters of from 2⅜" (or 2⅞") to 7".

As well as the mechanical valve assembly, the container may comprise a drain valve. For example this may be provided spaced away from the mechanical valve assembly to allow fluid therein to drain more readily when the apparatus is returning to surface.

Secondary Containers

In addition to the container (sometimes referred to below as a 'primary container') there may be one or more secondary containers, optionally each with respective control devices controlling fluid communication between the respective secondary container and the surrounding portion of the well or other portion of the apparatus.

The control devices of the secondary containers may include pumps, mechanical valves and/or latch assemblies.

A piston may be provided in one or more of the secondary containers. It may, for certain embodiments, function as the valve.

Alternatively, a floating piston may be controlled indirectly by the control device such as the valve. In some embodiments, the piston may be directly controlled by the latch assembly.

The latch assembly can control the floating piston—it can hold the floating piston in place against action of other forces (e.g. well pressure) and is released in response to an instruction from the electronic control mechanism.

Thus a secondary container can have a mechanical valve assembly (such as those described herein) latch assembly, or a pump, which regulates fluid communication between that secondary container and a surrounding portion of the well. The control device may or may not be provided at a port.

Thus there may be one, two, three or more than three secondary containers. The further control devices for the secondary containers may or may not move in response to a control signal, but may instead respond based on a parameter or time delay. Each control device for the respective secondary container can be independently operable. A common electronic communication device may be used for sending a control signal to a plurality of control devices.

The contents of the containers may or may not be miscible at the outlet. For example one container can have a polymer and a second container a cross linker, when mixed, in use, in the well form a gel or otherwise set/cure. The containers can be configured differently, for example have different volumes or chokes etc.

The secondary containers may have a different internal pressure compared to the pressure of the surrounding portion of the well. If less than a surrounding portion of the well, they are referred to as 'underbalanced' and when more than a surrounding portion of the well they are referred to as 'overbalanced'. They may additionally or alternatively include a pump.

Thus (an) underbalanced, overbalanced, and/or pump controlled secondary container(s) as well as associated secondary port and control device may be provided, the secondary container(s) each preferably having a volume of at least one or at least five litres. The secondary containers may in use have a pressure lower/higher than the surrounding portion of the well normally for at least one minute, before the control device is activated optionally in response to the control signal. Fluids surrounding the secondary container can thus be drawn in (for underbalanced or pump controlled containers), optionally quickly, or fluids expelled (for overbalanced or pump controlled containers).

Thus, a plurality of primary, and/or secondary containers or apparatus may be provided each having different functions: one or more primary containers, and optionally one or more underbalanced containers and optionally one or more overbalanced containers and optionally one or more containers controlled by a pump.

This can be useful, for example, to partially clear a filter cake using an underbalanced container, before deploying an acid treatment onto the perforations using the primary container.

Alternatively, for a short interval manipulation, a skin barrier could be removed from the interval by acid release from the primary container and then the apparatus including a pump can be used to pump fluid from the interval.

Fluid from a first chamber within the container can go into another to mix before being released/expelled.

Electronics

The apparatus may comprise at least one battery optionally a rechargeable battery. The battery may be at least one of a high temperature battery, a lithium battery, a lithium oxyhalide battery, a lithium thionyl chloride battery, a lithium sulphuryl chloride battery, a lithium carbon-monofluoride battery, a lithium manganese dioxide battery, a lithium ion battery, a lithium alloy battery, a sodium battery, and a sodium alloy battery. High temperature batteries are those operable above 85° C. and sometimes above 100° C. The battery system may include a first battery and further reserve batteries which are enabled after an extended time in the well. Reserve batteries may comprise a battery where the electrolyte is retained in a reservoir and is combined with the anode and/or cathode when a voltage or usage threshold on the active battery is reached.

The battery and optionally elements of the control electronics may be replaceable without removing tubulars. They may be replaced by, for example, using wireline or coiled tubing. The battery may be situated in a side pocket.

The apparatus, especially the electronic control mechanism, preferably comprises a microprocessor. Electronics in the apparatus, to power various components such as the microprocessor, control and communication systems, and optionally the valve, are preferably low power electronics. Low power electronics can incorporate features such as low voltage microcontrollers, and the use of 'sleep' modes where the majority of the electronic systems are powered off and a low frequency oscillator, such as a 10-100 kHz, for example 32 kHz, oscillator used to maintain system timing and 'wake-up' functions. Synchronised wireless communication techniques can be used between different components of the system to minimize the time that individual components need to be kept 'awake', and hence maximise 'sleep' time and power saving.

The low power electronics facilitates long term use of the electronic control mechanism. The electronic control mechanism may be configured to be controllable by the control signal up to more than 24 hours after being run into the well, optionally more than 7 days, more than 1 month, more than 1 year, or up to 5 years. It can be configured to remain dormant before, and/or after, being activated.

Other Apparatus Options

In addition to the control signal, the apparatus may include pre-programmed sequences of actions, for example a valve opening and re-closing, or a change in valve member position; based on parameters for example time, pressure detected or not detected or detection of particular fluid or gas. For example, under certain conditions, the apparatus will perform certain steps sequentially—each subsequent step following automatically. This can be beneficial where a delay to wait for a signal to follow on could mitigate the usefulness of the operation.

The apparatus may have a mechanism to orientate it rotationally. Nozzles can also be provided in order to direct its effects towards the communication paths for example.

Normally the port is provided on a side face of the apparatus although certain embodiments can have the port provided in an end face.

A further check valve, where present, may resist fluid entry into the container.

A pump may be provided to move the floating piston back, optionally to repeat a procedure.

Method

The "void" of the apparatus is, in use, commonly filled with fluid and so the skilled person will realise it is no longer, in use, a "void". Nonetheless this nomenclature is maintained herein for consistency even when describing the apparatus and the void in use.

Thus in use, the volume of the section which includes the fluids to be expelled reduces in volume due to movement of the floating piston and associated control member.

For certain embodiments, the fluid to be expelled is in the second section of the void in use, and the third section of the void having a pressure less than the pressure in the surrounding portion of the well for at least one minute.

Thus, in accordance with a further aspect of the invention, there is provided a method to deliver fluids such as chemicals into a well or a formation, comprising:

providing an apparatus as described herein;

providing a fluid in the second section of the void; then, running the apparatus into the well;

after running the apparatus into the well, the pressure in the third section of the void being less than a surrounding portion of the well;

sending a control signal to the electronic communication device at least in part by a wireless control signal transmitted in at least one of the following forms: electromagnetic, and acoustic;

activate the piston control device to move the floating piston and control member and expel the fluid from the second section of the void into the well through the second port.

After running the apparatus into the well, the pressure in the third section of the void may be less than a surrounding portion for at least one minute.

For such embodiments, the second dynamic seal may be provided in a throat. The second dynamic seal does not normally move with the control member—it is stationary when the control member is moving.

In alternative embodiments, the fluid to be expelled is in the third section of the void in use, and the second section of the void having a pressure less than the pressure in the surrounding portion of the well for at least one minute.

Thus, in accordance with a further aspect of the invention, there is provided a second method to deliver fluids such as chemicals into a well or a formation, comprising:

providing an apparatus as described herein;

providing a fluid in the third section of the void; then running the apparatus into the well;

after running the apparatus into the well, the pressure in the second section of the void being less than a surrounding portion of the well;

sending a control signal to the electronic communication device at least in part by a wireless control signal transmitted in at least one of the following forms: electromagnetic, and acoustic;

activate the piston control device to move the floating piston and control member and expel the fluid from the third section of the void into the well through the second port.

After running the apparatus into the well, the pressure in the second section of the void may be less than a surrounding portion for at least one minute.

For such embodiments, the control member may comprise a second piston. Optionally the second dynamic seal is between the second piston and said second portion of the container. Normally the second dynamic seal moves with the control member, often the second piston.

The pressure in the second or third section of the apparatus being less than a surrounding pressure is often maintained much longer than a minute, such as more than 1 hour, or more than 8 hours or indeed for days or weeks.

The first port and second port may be in communication with respective surrounding portions of the well, the surrounding portions of the well being isolated from each other. For example there may be a packer between the surrounding portion of the well/exit of the first port and the respective surrounding portion of the well/exit of the second port. Similarly one port may be in communication with the inside of a tubular and another port may be in communication with an outside of the tubular.

The fluid may be a mixture of different substances.

The invention thus provides a method to deliver fluids such as chemicals into a well or a formation, comprising:

providing an apparatus as described herein;

providing a fluid in one of the second and third sections of the void; then, running the apparatus into the well;

after running the apparatus into the well, the pressure in the other of the second and third sections of the void being less than a surrounding portion of the well;

sending a control signal to the electronic communication device at least in part by a wireless control signal transmitted in at least one of the following forms: electromagnetic and acoustic;

activate the piston control device to move the floating piston and control member and expel the fluid from said one of second and third sections of the void where fluid is provided, into the well through the second port.

Signals

The wireless control signal is transmitted as electromagnetic (EM) and/or acoustic signals. Various signals may sent within the well by EM, acoustic, inductively coupled tubulars and coded pressure pulsing and references herein to "wireless", relate to said forms, unless where stated otherwise.

Signals, unless otherwise stated, include control and data signals and these may independently include the features described herein for signals more generally. The control signals can control downhole devices including sensors. Data from sensors may be transmitted in response to a control signal. Moreover data acquisition and/or transmission parameters, such as acquisition and/or transmission rate or resolution, may be varied using suitable control signals.

Coded Pressure Pulses

Pressure pulses include methods of communicating from/to within the well/borehole, from/to at least one of a further location within the well/borehole, and the surface of the well/borehole, using positive and/or negative pressure changes, and/or flow rate changes of a fluid in a tubular and/or annular space.

Coded pressure pulses are such pressure pulses where a modulation scheme has been used to encode commands and/or data within the pressure or flow rate variations and a transducer is used within the well/borehole to detect and/or generate the variations, and/or an electronic system is used within the well/borehole to encode and/or decode commands and/or the data. Therefore, pressure pulses used with an in-well/borehole electronic interface are herein defined as coded pressure pulses. An advantage of coded pressure pulses, as defined herein, is that they can be sent to electronic interfaces and may provide greater transmission rate and/or bandwidth than pressure pulses sent to mechanical interfaces.

Where coded pressure pulses are used to transmit control signals, various modulation schemes may be used to encode control signals such as a pressure change or rate of pressure change, on/off keyed (OOK), pulse position modulation (PPM), pulse width modulation (PWM), frequency shift keying (FSK), pressure shift keying (PSK), amplitude shift keying (ASK), combinations of modulation schemes may also be used, for example, OOK-PPM-PWM. Transmission rates for coded pressure modulation schemes are generally low, typically less than 10 bps, and may be less than 0.1 bps.

Coded pressure pulses can be induced in static or flowing fluids and may be detected by directly or indirectly measuring changes in pressure and/or flow rate. Fluids include liquids, gasses and multiphase fluids, and may be static control fluids, and/or fluids being produced from or injected in to the well.

Preferably the wireless signals are such that they are capable of passing through a barrier, such as a plug or said annular sealing device, when fixed in place, and therefore preferably able to pass through the isolating components. Preferably therefore the wireless signals are transmitted in at least one of the following forms: electromagnetic, acoustic, and inductively coupled tubulars.

EM/Acoustic and coded pressure pulsing use the well, borehole or formation as the medium of transmission. The EM/acoustic or pressure signal may be sent from the well, or from the surface. If provided in the well, an EM/acoustic signal can travel through any annular sealing device, although for certain embodiments, it may travel indirectly, for example around any annular sealing device.

Electromagnetic and acoustic signals are especially preferred—they can transmit through/past an annular sealing device without special inductively coupled tubulars infrastructure, and for data transmission, the amount of information that can be transmitted is normally higher compared to coded pressure pulsing, especially receiving data from the well.

Therefore, the electronic communication device may comprise an acoustic communication device and the control signal comprises an acoustic control signal and/or the communication device may comprise an electromagnetic communication device and the control signal comprises an electromagnetic control signal.

Similarly the transmitters and receivers used correspond with the type of wireless signals used. For example an acoustic transmitter and receiver are used if acoustic signals are used.

Where inductively coupled tubulars are used, there are normally at least ten, usually many more, individual lengths of inductively coupled tubular which are joined together in use, to form a string of inductively coupled tubulars. They have an integral wire and may be formed tubulars such as tubing, drill pipe, or casing. At each connection between adjacent lengths there is an inductive coupling. The inductively coupled tubulars that may be used can be provided by N O V under the brand Intellipipe®.

Thus, the EM/acoustic or pressure wireless signals can be conveyed a relatively long distance as wireless signals, sent for at least 200 m, optionally more than 400 m or longer which is a clear benefit over other short range signals. Embodiments including inductively coupled tubulars provide this advantage/effect by the combination of the integral wire and the inductive couplings. The distance travelled may be much longer, depending on the length of the well.

Data and commands within the signal may be relayed or transmitted by other means. Thus the wireless signals could be converted to other types of wireless or wired signals, and optionally relayed, by the same or by other means, such as hydraulic, electrical and fibre optic lines. In one embodiment, the signals may be transmitted through a cable for a first distance, such as over 400 m, and then transmitted via acoustic or EM communications for a smaller distance, such as 200 m. In another embodiment they are transmitted for 500 m using coded pressure pulsing and then 1000 m using a hydraulic line.

Thus whilst non-wireless means may be used to transmit the signal in addition to the wireless means, preferred configurations preferentially use wireless communication. Thus, whilst the distance travelled by the signal is dependent on the depth of the well, often the wireless signal, including relays but not including any non-wireless transmission, travel for more than 1000 m or more than 2000 m. Preferred embodiments also have signals transferred by wireless signals (including relays but not including non-wireless means) at least half the distance from the surface of the well to the apparatus.

Different wireless signals may be used in the same well for communications going from the well towards the surface, and for communications going from the surface into the well.

Thus, the wireless signal may be sent to the electronic communication device, directly or indirectly, for example making use of in-well relays above and/or below any annular sealing device. The wireless signal may be sent from the surface or from a wireline/coiled tubing (or tractor) run probe at any point in the well optionally above any annular sealing device. For certain embodiments, the probe may be positioned relatively close to any annular sealing device for example less than 30 m therefrom, or less than 15 m.

Acoustic

Acoustic signals and communication may include transmission through vibration of the structure of the well including tubulars, casing, liner, drill pipe, drill collars, tubing, coil tubing, sucker rod, downhole tools; transmission via fluid (including through gas), including transmission through fluids in uncased sections of the well, within tubulars, and within annular spaces; transmission through static or flowing fluids; mechanical transmission through wireline, slickline or coiled rod; transmission through the earth; transmission through wellhead equipment. Communication through the structure and/or through the fluid are preferred.

Acoustic transmission may be at sub-sonic (<20 Hz), sonic (20 Hz-20 kHz), and ultrasonic frequencies (20 kHz-2 MHz). Preferably the acoustic transmission is sonic (20 Hz-20 khz).

The acoustic signals and communications may include Frequency Shift Keying (FSK) and/or Phase Shift Keying (PSK) modulation methods, and/or more advanced derivatives of these methods, such as Quadrature Phase Shift Keying (QPSK) or Quadrature Amplitude Modulation (QAM), and preferably incorporating Spread Spectrum Techniques. Typically they are adapted to automatically tune acoustic signalling frequencies and methods to suit well conditions.

The acoustic signals and communications may be unidirectional or bi-directional. Piezoelectric, moving coil transducer or magnetostrictive transducers may be used to send and/or receive the signal.

EM

Electromagnetic (EM) (sometimes referred to as Quasi-Static (QS)) wireless communication is normally in the frequency bands of: (selected based on propagation characteristics)

- sub-ELF (extremely low frequency) <3 Hz (normally above 0.01 Hz);
- ELF 3 Hz to 30 Hz;
- SLF(super low frequency) 30 Hz to 300 Hz;
- ULF (ultra low frequency) 300 Hz to 3 kHz; and,
- VLF (very low frequency) 3 kHz to 30 kHz.

An exception to the above frequencies is EM communication using the pipe as a wave guide, particularly, but not exclusively when the pipe is gas filled, in which case frequencies from 30 kHz to 30 GHz may typically be used dependent on the pipe size, the fluid in the pipe, and the range of communication. The fluid in the pipe is preferably non-conductive. U.S. Pat. No. 5,831,549 describes a telemetry system involving gigahertz transmission in a gas filled tubular waveguide.

Sub-ELF and/or ELF are preferred for communications from a well to the surface (e.g. over a distance of above 100 m). For more local communications, for example less than 10 m, VLF is preferred. The nomenclature used for these ranges is defined by the International Telecommunication Union (ITU).

EM communications may include transmitting communication by one or more of the following: imposing a modulated current on an elongate member and using the earth as return; transmitting current in one tubular and providing a return path in a second tubular; use of a second well as part of a current path; near-field or far-field transmission; creating a current loop within a portion of the well metalwork in order to create a potential difference between the metalwork and earth; use of spaced contacts to create an electric dipole transmitter; use of a toroidal transformer to impose current in the well metalwork; use of an insulating sub; a coil antenna to create a modulated time varying magnetic field for local or through formation transmission; transmission within the well casing; use of the elongate member and earth as a coaxial transmission line; use of a tubular as a wave guide; transmission outwith the well casing.

Especially useful is imposing a modulated current on an elongate member and using the earth as return; creating a current loop within a portion of the well metalwork in order to create a potential difference between the metalwork and earth; use of spaced contacts to create an electric dipole transmitter; and use of a toroidal transformer to impose current in the well metalwork.

To control and direct current advantageously, a number of different techniques may be used. For example one or more of: use of an insulating coating or spacers on well tubulars; selection of well control fluids or cements within or outwith tubulars to electrically conduct with or insulate tubulars; use of a toroid of high magnetic permeability to create inductance and hence an impedance; use of an insulated wire, cable or insulated elongate conductor for part of the transmission path or antenna; use of a tubular as a circular waveguide, using SHF (3 GHz to 30 GHz) and UHF (300 MHz to 3 GHz) frequency bands.

Suitable means for receiving the transmitted signal are also provided, these may include detection of a current flow; detection of a potential difference; use of a dipole antenna; use of a coil antenna; use of a toroidal transformer; use of a Hall effect or similar magnetic field detector; use of sections of the well metalwork as part of a dipole antenna.

Where the phrase "elongate member" is used, for the purposes of EM transmission, this could also mean any elongate electrical conductor including: liner; casing; tubing or tubular; coil tubing; sucker rod; wireline; drill pipe; slickline or coiled rod.

A means to communicate signals within a well with electrically conductive casing is disclosed in U.S. Pat. No. 5,394,141 by Soulier and U.S. Pat. No. 5,576,703 by MacLeod et al both of which are incorporated herein by reference in their entirety. A transmitter comprising oscillator and power amplifier is connected to spaced contacts at a first location inside the finite resistivity casing to form an electric dipole due to the potential difference created by the current flowing between the contacts as a primary load for the power amplifier. This potential difference creates an electric field external to the dipole which can be detected by either a second pair of spaced contacts and amplifier at a second location due to resulting current flow in the casing or alternatively at the surface between a wellhead and an earth reference electrode.

Relay

A relay comprises a transceiver (or receiver) which can receive a signal, and an amplifier which amplifies the signal for the transceiver (or a transmitter) to transmit it onwards.

There may be at least one relay. The at least one relay (and the transceivers or transmitters associated with the apparatus or at the surface) may be operable to transmit a signal for at least 200 m through the well. One or more relays may be configured to transmit for over 300 m, or over 400 m.

For acoustic communication there may be more than five, or more than ten relays, depending on the depth of the well and the position of the apparatus.

Generally, less relays are required for EM communications. For example, there may be only a single relay. Optionally therefore, an EM relay (and the transceivers or transmitters associated with the apparatus or at the surface) may be configured to transmit for over 500 m, or over 1000 m.

The transmission may be more inhibited in some areas of the well, for example when transmitting across a packer. In this case, the relayed signal may travel a shorter distance. However, where a plurality of acoustic relays are provided, preferably at least three are operable to transmit a signal for at least 200 m through the well.

For inductively coupled tubulars, a relay may also be provided, for example every 300-500 m in the well.

The relays may keep at least a proportion of the data for later retrieval in a suitable memory means.

Taking these factors into account, and also the nature of the well, the relays can therefore be spaced apart accordingly in the well.

The control signals may cause, in effect, immediate activation, or may be configured to activate the apparatus after a time delay, and/or if other conditions are present such as a particular pressure change.

Annular Sealing Device

The apparatus may be provided in the well below an annular sealing device, the annular sealing device engaging with an inner face of casing or wellbore in the well, and being at least 100 m below a surface of the well. A connector is optionally also provided connecting the apparatus to the annular sealing device, the connector being above the apparatus and below the annular sealing device.

The annular sealing device may be at least 300 m from the surface of the well. The surface of the well is the top of the uppermost casing of the well.

The annular sealing device is a device which seals between two tubulars (or a tubular and the wellbore), such as a packer element or a polished bore and seal assembly.

The packer element may be part of a packer, bridge plug, or liner hanger, especially a packer or bridge plug.

A packer includes a packer element along with a packer upper tubular and a packer lower tubular along with a body on which the packer element is mounted.

The packer can be permanent or temporary. Temporary packers are normally retrievable and are run with a string and so removed with the string. Permanent packers on the other hand, are normally designed to be left in the well (though they could be removed at a later time).

The annular sealing device may be wirelessly controlled.

A sealing portion of the annular sealing device may be elastomeric, non-elastomeric and/or metallic.

It can be difficult to control apparatus in the area below an annular sealing device between a casing/wellbore and an inner production tubing or test string, especially independent of the fluid column in the inner production tubing. Thus embodiments of the present invention can provide a degree of control in this area.

Kill fluid may be present inside tubing in the well above the annular sealing device before the apparatus is activated.

Connector

The connector is a mechanical connection (as opposed to a wireless connection) and may comprise, at least in part, a tubular connection for example some lengths of tubing or drill pipe. It may include one or more of perforation guns, gauge carriers, cross-overs, subs and valves. The connector may comprise or consist of a threaded connection. The connector does not consist of only wireline, and normally does not include it.

Normally the connector comprises a means to connect to the annular sealing device, such as a thread or dogs.

The connector may be within the same casing that the annular sealing device is connected to.

The connector may comprise a plug for example in the tubing (which is separate from the annular sealing device which may also comprise a plug).

Sensors

The apparatus and/or the well (above and/or especially below the annular sealing device) may comprise at least one pressure sensor. The pressure sensor(s) may be below the annular sealing device and may or may not form part of the apparatus. It can be coupled (physically or wirelessly) to a wireless transmitter and data can be transmitted from the wireless transmitter to above the annular sealing device or otherwise towards the surface. Data can be transmitted in at least one of the following forms: electromagnetic, acoustic and inductively coupled tubulars, especially acoustic and/or electromagnetic as described herein above.

Such short range wireless coupling may be facilitated by EM communication in the VLF range.

Optionally the apparatus comprises a volume indicator such as an empty/full indicator or a proportional indicator. A means to recover the data from the volume indicator is also normally included. The apparatus may comprise a pressure gauge, arranged to measure internal pressure in the container. The electronic communication device may be configured to send signals from the pressure gauge wirelessly.

Preferably at least temperature and pressure sensors are provided. A variety of sensors may be provided, including acceleration, vibration, torque, movement, motion, radiation, noise, magnetism, corrosion; chemical or radioactive tracer detection; fluid identification such as hydrate, wax and sand production; and fluid properties such as (but not limited to) flow, density, water cut, for example by capacitance and conductivity, pH and viscosity. Furthermore the sensor(s) may be adapted to induce the signal or parameter detected by the incorporation of suitable transmitters and mechanisms. The sensor(s) may also sense the status of other parts of the apparatus or other equipment within the well, for example valve member position or motor rotation.

Following operation of the device, data from the pressure sensor(s), and optionally other sensors, may be used, at least in part, to determine whether to conduct or how to better optimise a well/reservoir treatment such as an acid treatment, a hydraulic fracturing or minifrac operation and/or a well test.

An array of discrete temperature sensors or a distributed temperature sensor can be provided (for example run in) with the apparatus. Optionally therefore it may be below the annular sealing device. These temperature sensors may be contained in a small diameter (e.g. ¼") tubing line and may be connected to a transmitter or transceiver. If required any number of lines containing further arrays of temperature sensors can be provided. This array of temperature sensors and the combined system may be configured to be spaced out so the array of temperature sensors contained within the tubing line may be aligned across the formation, for example the communication paths; either for example generally parallel to the well, or in a helix shape.

The array of discrete temperature sensors may be part of the apparatus or separate from it.

The temperature sensors may be electronic sensors or may be a fibre optic cable.

Therefore in this situation the additional temperature sensor array could provide data from the communication path interval(s) and indicate if, for example, communication paths are blocked/restricted. The array of temperature sensors in the tubing line can also provide a clear indication of fluid flow, particularly when the apparatus is activated. Thus for example, more information can be gained on the response of the communication paths—an upper area of communication paths may have been opened and another area remain blocked and this can be deduced by the local temperature along the array of the temperature sensors.

Such temperature sensors may also be used before, during and after expelling the fluid and therefore used to check the effectiveness of the apparatus.

Moreover, for certain embodiments, multiple longitudinally spaced containers are activated sequentially, and the array of temperature sensors used to assess the resulting flow from communication paths.

Data may be recovered from the pressure sensor(s), before, during and/or after the valve member is moved in response to the control signal. Recovering data means getting it to the surface.

Data may be recovered from the pressure sensor(s), before, during and/or after a perforating gun has been activated in the well.

The data recovered may be real-time/current data and/or historical data.

Data may be recovered by a variety of methods. For example it may be transmitted wirelessly in real time or at a later time, optionally in response to an instruction to transmit. Or the data may retrieved by a probe run into the well on wireline/coiled tubing or a tractor; the probe can optionally couple with the memory device physically or wirelessly.

Memory

The apparatus especially the sensors, may comprise a memory device which can store data for recovery at a later time. The memory device may also, in certain circumstances, be retrieved and data recovered after retrieval.

The memory device may be configured to store information for at least one minute, optionally at least one hour, more optionally at least one week, preferably at least one month, more preferably at least one year or more than five years.

The memory device may be part of sensor(s). Where separate, the memory device and sensors may be connected together by any suitable means, optionally wirelessly or physically coupled together by a wire. Inductive coupling is also an option.

Short range wireless coupling may be facilitated by EM communication in the VLF range.

Well/Reservoir Treatment

For certain embodiments therefore, the container comprises a chemical or other fluid to be delivered, such as an acid, and "acid" treatments such as "acid wash" or "acid injection" can be conducted. This may comprise hydrochloric acid or other acids or chemicals used for such so-called acid treatments. The treatment fluid could be treatment or delivery of the fluids to the well or the formation, such as scale inhibitor, methanol/glycol; or delivering gelling or cutting agents e.g. bromine trifluoride, breaker fluid, tracer or a chemical or acid treatment.

The method may be used to clear or extend communication paths or clear the well of any type of debris. This may improve well flow and/or be used to clear a portion of the well prior to or after perforating or at other times.

Communication path(s) can be perforations created in the well and surrounding formation by a perforating gun. In some cases, use of a perforating gun to provide communication path(s) is not required. For example the well may be open hole and/or it may include a screen/gravel packs, slotted sleeve or a slotted liner or has previously been perforated. References to communication path(s) herein include all such examples where access to the formation is provided and is not limited to perforations created by perforating guns.

Acid wash normally treats the face of the wellbore, or may treat scale within a wellbore. Acids may be directed towards the specific communication paths that are damaged, for example by using openings in a tube.

A conventional acid set-up and treatment conducted from surface is a time-consuming and therefore expensive process. Instead of a conventional acid treatment the method according to the invention may be performed to try to mitigate debris. Debris may include perforation debris and/or formation damage such as filter cake.

The apparatus is suitable for both openhole and perforated sections and can be run with or without a perforation device.

Deployment

An annular sealing device may or may not be present in the well.

For certain embodiments, the apparatus may be deployed with an annular sealing device or after an annular sealing device is provided in the well following an earlier operation. In the former case, it may then be provided on the same string as the annular sealing device and deployed into the well therewith. In the latter case, it may be retro-fitted into the well and optionally below the annular sealing device. In this latter example, it is normally connected to a plug or hanger, and the plug or hanger in turn connected directly or indirectly, for example by tubulars, to the annular sealing device. The plug may be a bridge plug, wireline lock, tubular/drill pipe set barrier, shut-in tool or retainer such as a cement retainer. The plug may be a temporary or permanent plug.

Also, the apparatus may be provided in the well and then an annular sealing device deployed and set thereabove and then the method described herein performed after the annular sealing device is run in.

The container may be sealed at the surface, and then deployed into the well. 'At surface' in this context is typically outside of the well although it could be sealed whilst in a shallow position in the well, such as up to 30 metres from the surface of the well, that is the top of the uppermost casing of the well. Thus the apparatus moves from the surface and is positioned in the well with the container sealed, before operating the piston control device. Depending on the particular embodiment and the deployment method, it may be run in a well with no annular sealing device, or with the annular sealing device already thereabove or move past a previously installed annular sealing device.

For certain embodiments, the entire apparatus may be below the annular sealing device, as opposed to a portion of the apparatus.

The port of the apparatus may be provided within 100 m of a communication path between the well and the reservoir, optionally 50 m or 30 m. If there is more than one communication path, then the closest communication path is used to determine the spacing from the port of the apparatus. Optionally therefore, the port in the container may be spaced below communication paths in the well. This can assist in moving debris away from the communication path(s) to help clear them.

In certain embodiments, the apparatus may be run on a tubular string, such as a test, completion, suspension, abandonment, drill, tubing, casing or liner string. Alternatively, the apparatus may also be conveyed into the well on wireline or coiled tubing (or a tractor). The apparatus may be an integral part of the string.

The apparatus is typically connected to a tubular before it is operated. Therefore whilst it may be run in by a variety of means, such as wireline or tubing, it is typically connected to a tubular such as drill pipe, production tubing or casing when in the well, before it is operated. This provides flexibility for various operations on the well.

The connection may be by any suitable means, such as by being threaded, gripped, latched etc. onto the tubular. Thus normally the connection between the tubular takes some of the weight of the apparatus, albeit this would not necessarily happen in horizontal wells.

The string may be deployed as part of any suitable well operation, including drilling, well testing, shoot and pull, completion, work-over, suspension and/or abandonment operation.

The string may include perforating guns, particularly tubing conveyed perforating guns. The guns may be wirelessly activatable such as from EM and/or acoustic signals.

In such a scenario, there may not be straightforward access below guns to the lower zone(s). Thus when run with such a string, embodiments of the invention provide means to expel fluids in such a zone.

A plurality of apparatus described herein may be run on the same string. For example spaced apart and positioned within one section or isolated sections. Thus, the apparatus may be run in a well with multiple isolated sections adjacent different zones. When the second port of the apparatus is isolated from the surface of the well, flow may continue from a separate zone of the well, which is not in pressure communication with the port, and not isolated from the surface of the well.

The apparatus may be dropped off an associated carrying string after the valve member has been opened or for any other reason (for example it is not required and is not possible or useful to return it to surface). Thus it is not always necessary to return it to the surface.

A variety of arrangements of the apparatus in the well may be adopted. The apparatus may be positioned substantially in the centre of the well. Alternatively the apparatus may be configured as an annular tool to allow well flow through the inner tubular, therefore, the container is formed in an annular space between two tubes and the well can flow through the inner tube.

In other embodiments, the apparatus can be offset within the well, for example attached/clamped onto the outside of a pipe or mounted offset within a pipe. Thus it can be configured so apparatus or other objects (or fluid flow) can move through the bore of the pipe without being impeded. For example it may have a diameter of 1¾ inches offset inside a 4" inner diameter outer pipe. In this way, one or more wireline apparatus can still run past it, as can fluid flow.

For certain embodiments, the apparatus may be deployed in a central bore of a pre-existing tubular in the well, rather than into a pre-existing annulus in the well. An annulus may be defined by the apparatus and the pre-existing tubular in the well.

The apparatus may be run into the well as a permanent apparatus designed to be left in the well, or run into the well as a retrievable apparatus which is designed to be removed from the well.

Optionally the second (and/or first) port of the apparatus may be isolated from a surface of the well.

The entire apparatus, and not just one or both ports of the apparatus, may be isolated from the surface of the well.

Isolating one or both ports of the apparatus from the surface of the well means preventing pressure or fluid communication between the respective port(s) and the surface of the well.

Isolation can be achieved using the well infrastructure and isolating components. Isolating components comprise packers, plugs such as bridge plugs, valves, and/or the apparatus. Thus the annular sealing device is normally an isolating component and along with other isolating components and well infrastructure can isolate the port of the apparatus from the surface of the well. In certain embodiments therefore, more than one isolating component can isolate one or both ports of the apparatus from the surface of the well. For example, a packer may be provided in an annulus and a valve provided in a central tubing and together they isolate one or both ports of the apparatus from the surface of the well. In such cases the uppermost extent of the well section that contains one or both ports of the apparatus is defined by the uppermost isolating component.

In contrast, well infrastructure comprises cement in an annulus, casing and/or other tubulars.

Isolating one or both ports of the apparatus from the surface of the well involves isolating the section of the well containing one or both ports downhole, such that the uppermost isolating component in that isolated well section is at least 100 m from the surface of the well, optionally at least 250 m, or at least 500 m.

The second port of the apparatus is typically at least 100 m from the uppermost isolating component in the same section of the well. In certain embodiments, the second port of the apparatus is at most 500 m from the uppermost isolating component in the same section of the well, optionally at most 200 m therefrom.

The well or a section thereof may be shut in downhole before the apparatus is operated. This can reduce the volume exposed to the apparatus which then focuses the released fluid to the intended area.

The isolating components may be upper isolating components, and lower isolating components may be used to isolate a section of the well from a further section therebelow.

Thus embodiments of the present invention allow the release of fluids in a lower isolated section of a well where it may not have hitherto been possible, convenient or indeed safe to do so using conventional means such as fluid control lines to surface.

The well may be a production well.

Clearing and Testing

The method according to the invention may be a method to expel fluids into the well may be used to clear it of some debris, by for example an acid treatment. This may improve well flow and/or be used to clear a portion of the well prior to or after perforating or at other times.

The apparatus may be used to deliver chemicals such as tracers, breaker fluids or fluids for an acid treatment. Chemical barriers may also be deployed, or precursors to a chemical barrier e.g. cement type material.

As an alternative to cement, a solidifying cement substitute such as epoxies and resins, or a non-solidifying cement substitute may be used such as Sandaband™. References herein to cement include such cement substitutes.

An advantage of such embodiments is being able to deploy chemicals in parts of a well in which it may not be possible to deploy, or viably deploy, using conventional means.

The method to deliver fluids such as chemicals into a well can be a method to at least partially clear the well optionally in preparation for a procedure/test.

Thus according to a further aspect of the present invention there is provided a method to conduct a procedure or test on a well, comprising:

conducting the method to deliver fluids to the well or formation, as described herein;

conducting a procedure/test on the well, the procedure/test includes one or more of image capture, connectivity tests such as an interference or pulse test, build-up test, drawdown test, a drill stem test (DST), extended well test (EWT), hydraulic fracturing, minifrac, pressure test, flow test, injection test, well/reservoir treatment such as an acid treatment, permeability test, injection procedure, gravel pack operation, perforation operation, string deployment, workover, suspension and abandonment.

The test is normally conducted on the well before removing the apparatus from the well, if it is removed from the well.

Embodiments of said further aspect may improve the pressure or fluid communication across the face of the formation and improve the performance of tests.

The method to conduct a test/procedure on the well may also include perforating the well. However, the method of the present invention may be independent from operation of the guns. The well may be openhole and/or pre-perforated.

Thus the method of the invention can improve the reliability and/or quality of data received from subsequent testing. The apparatus may be used to clear the surrounding area, for example by expelling a clear fluid, before images are captured.

In certain embodiments, the fluid in the container is released gradually over several seconds (such as 5-10 seconds), or longer (such as 2 minutes-6 hours) or even very slow (such as 1-7 days). Choke functionality is therefore particularly useful.

A pulse test is where a pressure pulse is induced in a formation at one well/isolated section of the well and detected in another "observing" well or separate isolated section of the same well, and whether and to what extent a pressure wave is detected in the observing well or isolated section, provides useful data regarding the pressure connectivity of the reservoir between the wells/isolated sections. Such information can be useful for a number of reasons, such as to determine the optimum strategy for extracting fluids from the reservoir.

An interference test is similar to a pulse test, though monitors longer term effects at an observation well/isolated section following production (or injection) in a separate well or isolated section.

For such connectivity tests, the well according to embodiments of the present invention is the observing well/isolated section. Thus the method described herein may include observing for pressure changes in the well as part of a connectivity test.

For certain other embodiments however, the method of manipulating the well may be the well—particularly the isolated section—from where pulses are sent using the apparatus. For example, in a multi-lateral well, the apparatus may send a pressure pulse from one side-track of the same well to another. Side tracks (or the main bore) of wells which are isolated from each other are defined herein as separate isolated sections.

Short Interval

The annular sealing device may be a first annular sealing device.

The second port may be positioned between two portions of the or an annular sealing device (or two annular sealing devices), and the valve member moved in response to the control signal to expel the fluid in the container to the adjacent well/reservoir in order to conduct a short interval procedure.

Often, the portions are two separate annular sealing devices are used and spaced apart to define the short interval. However, a single annular sealing device can be used and the port provided between two portions of the same annular sealing device.

Annular sealing devices used with the short interval procedure normally comprise a packer element. The packer elements may be from inflatable packers especially for openhole.

Thus there can be a second annular sealing device below the first (or a further) annular sealing device where at least the (normally second) port of the apparatus is positioned below the first/further annular sealing device and above the second annular sealing device. The entire apparatus may be positioned above the second annular sealing device. This second annular sealing device may be wirelessly controlled. Thus it may be expandable and/or retractable by wireless signals.

The short interval, e.g. the distance between two annular sealing devices, may be less than 30 m, optionally less than 10 m, optionally less than 5 m or less than 2 m, less than 1 m, or less than 0.5 m. These distances are taken from lowermost point of an upper packer element of the (first) annular sealing device, and the uppermost point of a lower packer element of the second annular sealing device. Thus this can limit the volume and so the apparatus is more effective when the port is exposed to the limited volume.

The apparatus may be a part of a string which includes a drill bit. The annular sealing devices may be mounted on said string, and activated to engage with an outer well casing or wellbore.

The short interval procedure is especially useful in an openhole i.e. uncased section of a well.

For certain embodiments, such a test can provide an initial indication on the reservoir response to a well/reservoir treatment.

A short interval test (one or more) may be performed whilst doing a traditional test in an upper or lower zone e.g. a drill stem test (DST).

Miscellaneous

The well may be a subsea well. Wireless communications can be particularly useful in subsea wells because running cables in subsea wells is more difficult compared to land wells. The well may be a deviated or horizontal well, and embodiments of the present invention can be particularly suitable for such wells since they can avoid running wireline, cables or coiled tubing which may be difficult or not possible for such wells.

References herein to perforating guns includes perforating punches or drills, all of which are used to create a flowpath between the formation and the well.

The surrounding portion of the well, is the portion of the well surrounding the apparatus immediately before the piston control device is activated in response to the control signal. More precisely it is the pressure of the fluid at or 'surrounding' the first port.

The volume of the container is its fluid capacity.

Transceivers, which have transmitting functionality and receiving functionality; may be used in place of the transmitters and receivers described herein.

Unless indicated otherwise, any references herein to "blocked" or "unblocked" includes partially blocked and partially unblocked.

All pressures herein are absolute pressures unless stated otherwise.

The well is often an at least partially vertical well. Nevertheless, it can be a deviated or horizontal well. References such as "above" and below" when applied to deviated or horizontal wells should be construed as their equivalent in wells with some vertical orientation. For example, "above" is closer to the surface of the well through the well.

A zone is defined herein as formation adjacent to or below the lowermost barrier or annular sealing device, or a portion of the formation adjacent to the well which is isolated in part between barriers or annular sealing devices and which has, or will have, at least one communication path (for example perforation) between the well and the surrounding formation, between the barriers or annular sealing devices. Thus each additional barrier or annular sealing device set in the well defines a separate zone except areas between two barriers or annular sealing devices (for example a double barrier) where there is no communication path to the surrounding formation and none are intended to be formed.

"Kill fluid" is any fluid, sometimes referred to as "kill weight fluid", which is used to provide hydrostatic head typically sufficient to overcome reservoir pressure.

Embodiments of the invention will now be described by way of example only and with reference to the accompanying drawings, in which:

FIG. 1*a* shows a downhole apparatus in accordance with one aspect of the present invention;

FIG. 1*b* shows an alternative embodiment of the FIG. 1*a* downhole apparatus;

FIG. 2*a* shows a downhole apparatus in accordance with one aspect of the present invention;

FIG. 2*b* shows a further embodiment of a downhole apparatus in accordance with the present invention;

Figure 1A:
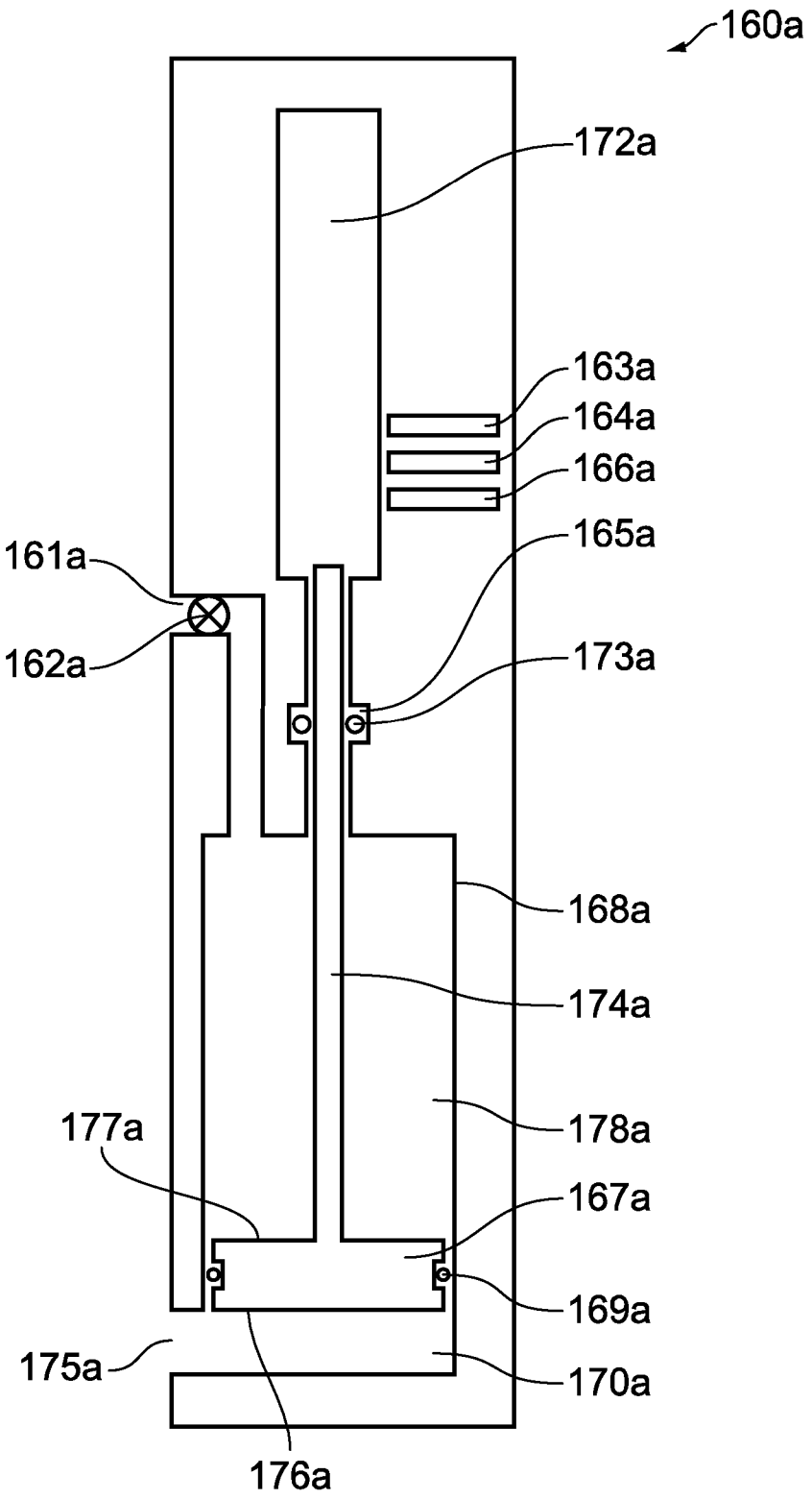

FIG. 1*a* shows a downhole apparatus 160*a* comprising a container 168*a* and a first pressure balancing port 175*a* and a second port 161*a* to selectively allow fluid discharge from the container 168*a* into a surrounding portion of a well, depending on the position of a valve member (not shown in FIG. 1) of a control valve 162*a*.

The container 168*a* is separated into a fluid container 178*a* and an underbalanced chamber 172*a*. The apparatus 160*a* further comprises a floating piston 167*a* which separates the container 168*a* into a pressure balance section 170*a* and the fluid container 178*a*. The floating piston 167*a* is sealed in the container 168*a* via a first dynamic seal 169*a*, and can move therein depending on the forces acting on its upper side 177*a* and its lower side 176*a*. A rod 174*a* extends from the upper side 177*a* of the floating piston 167*a* into the underbalanced chamber 172*a* and is sealed in a throat 165*a* by a second dynamic seal 173*a*. The second dynamic seal thus seals the fluid container 178*a* from the underbalance container 172*a*. Thus first 170*a*, second 178*a* and third 172*a* sections of the fluid container 168*a* are provided. The cross-sectional area defined by the seal 169*a* is larger than the cross-sectional area defined by the seal 173*a*.

The first port 175*a* is provided in the container 168*a* between the pressure balance section 170*a* and the surrounding portion of the well. The second port 161*a* comprises a control valve 162*a* which can selectively move to allow or resist movement of fluid from the fluid container 178*a* to the surrounding portion of the well via the second port 161*a*.

An electronic control mechanism comprises an electronic communication device in the form of an EM or acoustic wireless transceiver 164*a*, and a valve controller 166*a*; the electronic control mechanism being configured to receive an EM or acoustic control signal to instruct the control valve 162*a* to open and/or close and in turn, as described below, control the piston. A battery 163*a* is also provided to power electronics such as the transceiver 164*a* and valve controller 166*a*. Alternatively, separate batteries may be provided for each powered component.

The components of the electronic control mechanism (the transceiver 164*a* and the valve controller 166*a* which controls the valve 162*a*) are normally provided adjacent each other, or close together as shown; but may be spaced apart.

In use, the downhole apparatus 160*a* is initially assembled at the surface under atmospheric pressure conditions. The fluid container 178*a* is filled, via a fill port (not shown), with the desired fluid to be deployed, and the underbalance chamber is filled with air and sealed at atmospheric pressure by the seal 173*a*. The lower side 176*a* of the floating piston 167*a* is level or above the top of the first port 175*a*, that is the floating piston 167*a* does not block or cover the first port 175*a*.

Once the fluid container 178*a* is filled with fluid, it is then isolated therein by the first 169*a* and the second 173*a* dynamic seals.

The apparatus 160*a* is then run into a well until it reaches a desired depth. As depth increases, the surrounding well pressure increases. However, the second dynamic seal 173*a* isolates the underbalance chamber 172*a* from the fluid container 178*a*, thus allowing the underbalance chamber 172*a* to remain substantially at atmospheric pressure which is less than the surrounding pressure.

The first port 161*a* is opened to the surrounding well, and so the pressure in the first section 170*a* of the container 168*a* is the same as the surrounding well pressure. The pressure within the underbalance chamber 172*a* is significantly lower than the pressure in the surrounding well.

When the control valve 162*a* is opened, well pressure acts on both sides 176*a*, 177*a* of the piston 167*a* via the ports 175*a*, 161*a* respectively which is effectively the same pressure. The underbalance of pressure in the chamber 172*a* reduces the force on the upper 177*a* side of the piston 167*a* compared to the force on the lower side 176*a* of the piston 167*a* and so it moves towards the second port 161*a*. The upward movement of the floating piston 167*a* causes the fluid within the fluid container 178*a* to be expelled into the well through the second port 161*a*. In this way, the control valve 162*a* controls movement of the floating piston 167*a*.

For certain embodiments, the coupling between the rod 174*a* and the floating piston 167*a* is flexible.

Figure 1B:
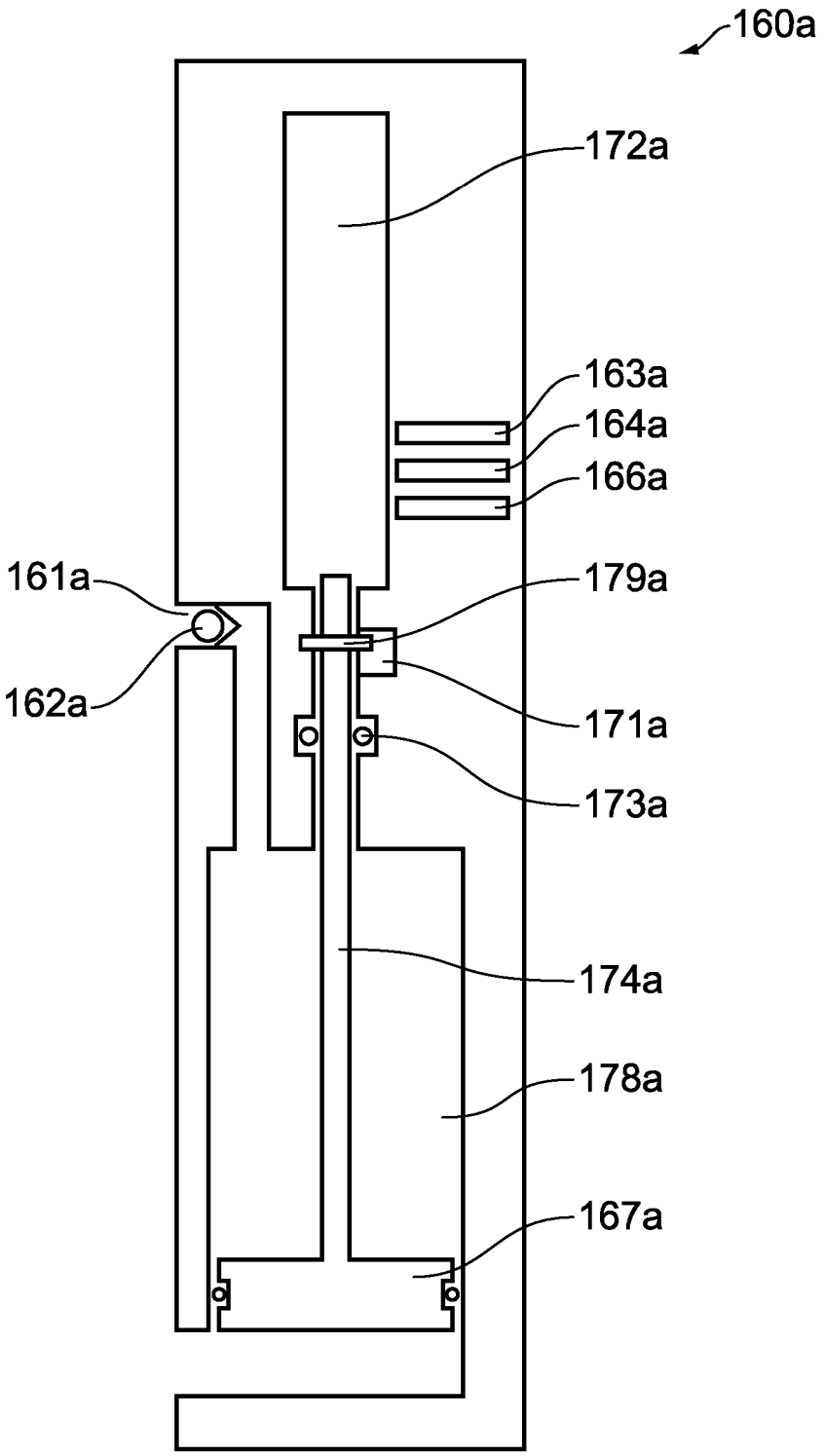

FIG. 1*b* shows an alternative embodiment of the FIG. 1*a* downhole apparatus 160*a*, comprising a control valve 162*a* which allows fluid to flow from the fluid container 178*a* to the surrounding portion of the well via the second port 161*a*. To control the movement of the floating piston 167*a*, the apparatus 160*a* further comprises a latch mechanism 171*a* with a latch member 179*a*. The latch member 179*a* has a closed position, as shown in FIG. 1*b*, and an open position (not shown). In the closed position, the latch mechanism prevents the rod 174*a* and associated floating piston 167*a* from moving. Thus when in position in the well, the same imbalance of forces acts on the floating piston 167*a* as described above, caused by the underbalance chamber 172*a*. Therefore the piston 167*a* is urged upwards (as drawn) towards the underbalanced chamber 172*a*. Before expulsion of the fluids, rather than being resisted by a controllable valve; in the present embodiment, this movement is resisted by the latch mechanism 171*a* and associated latch member 179*a*. This in turn prevents fluid flowing from the fluid container 178*a* to the surrounding portion of the well via the second port 161*a*.

The latch mechanism 171*a* is controlled by a valve controller 166*a*, and a EM or acoustic communication device in the form of a transceiver 164*a* is coupled to the valve controller 166*a* which is configured to receive a EM or acoustic control signal to instruct the latch mechanism 171*a* to open and/or close the latch member 179*a*. When it is intended to expel fluids, the latch member 179*a* is opened, and the floating piston moves towards the underbalanced chamber 172*a* because of the same imbalance of forces thereon, as described with respect to the FIG. 1*a* embodiment. The expulsion of fluid into the well through the control valve 162*a* of the second port 161*a* results.

Figure 2A:
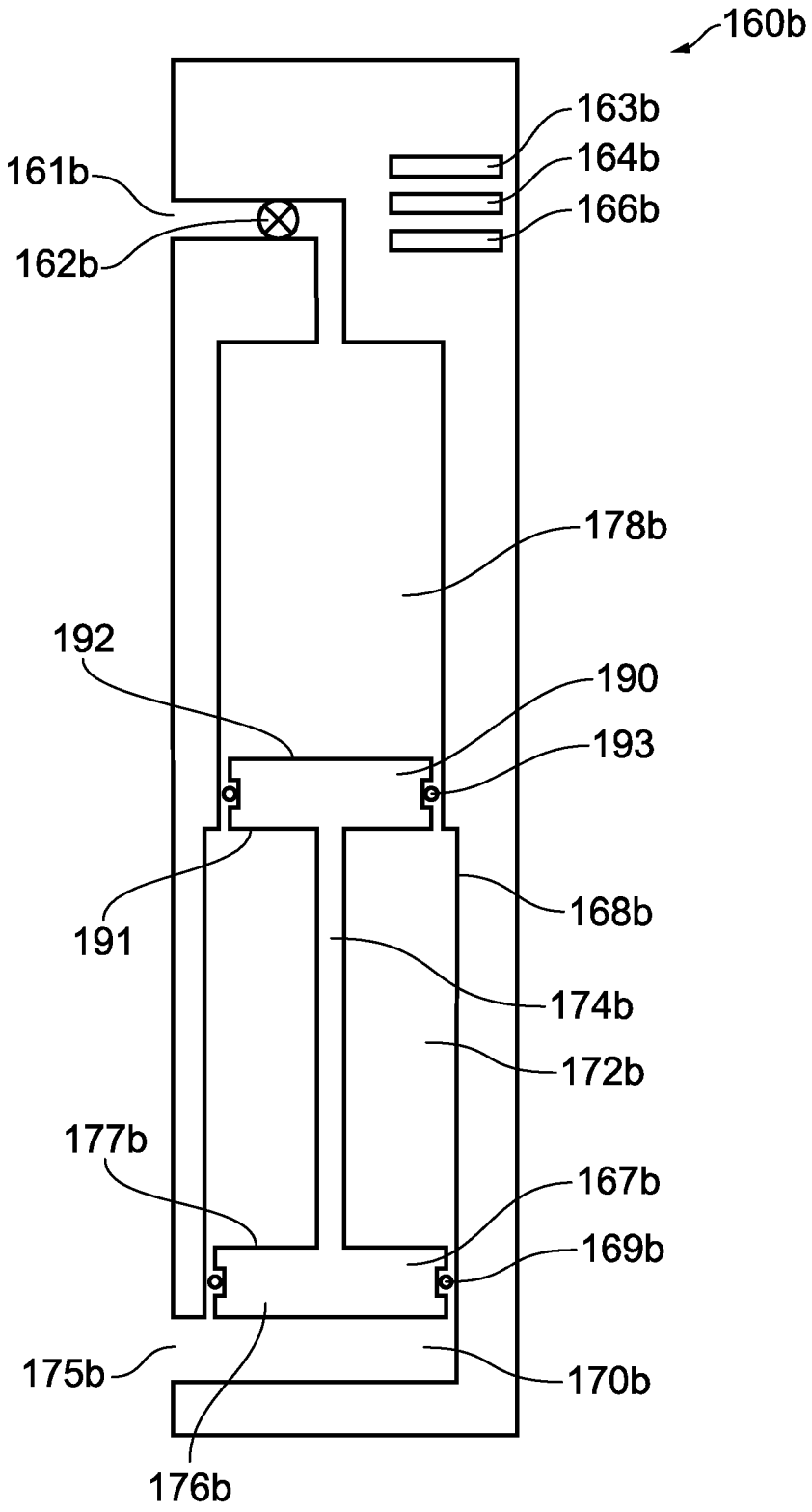

FIG. 2*a* shows a further embodiment which includes like parts with the FIGS. 1*a* & 1*b* embodiments and these are not described again in detail. The reference numerals of the like parts share the same three digits in both embodiments, but differ in that they are suffixed with a 'b' in the FIG. 2*a* embodiment instead of an 'a'.

In contrast to FIG. 1*a*, the FIG. 2*a* embodiment shows a fluid container 178*b* and an underbalance chamber 172*b* swapped around, such that the underbalance chamber 172*b* is positioned in between a first floating piston 167*b* and a second floating piston 190, the floating pistons 167*b*, 190 being connected to each other by a rod 174*b*. The rod 174*b* is attached to the upper side 177*b* of the first floating piston 167*b* and a lower side 191 of the second floating piston 190. On an upper side 192 of the second floating piston 190 is the fluid container 178*b* containing the fluids to be expelled. Thus first 170*b*, second 172*b* and third 178*b* sections of the fluid container 168*b* are provided.

The cross-sectional area of the first piston 167*b* is larger than the second piston 190, and each are sealed against the container by seals 169*b* and 193 respectively. Thus, the cross-sectional area defined by the seal 169*b* is larger than the cross-sectional area defined by the seal 193.

As shown in FIG. 2*a*, a second port 161*b* comprises a control valve 162*b* which can selectively move to allow fluid discharge from the fluid container 178*b* to the surrounding portion of the well. The control valve 162*b* is controlled by a valve controller 166*b* and transceiver 164*b* as described above with respect to the apparatus 160*a*. A battery 163*b* may be similarly provided.

In use, the fluid container 178*b* is filled with the required fluid at the surface and the underbalance chamber 172*b* filled and sealed with air at atmospheric pressure before being run into the well where the underbalance chamber 172*b* will have a much lower pressure than the surrounding portion of the well.

When in position in the well, the control valve 162*b* controls the movement of the pistons 167*b* and 190. The control valve 162*b* is opened and well pressure then acts on the upper 192 side of the floating piston 190 via the port 161*b*, as well as a lower side 176*b* of the first piston 167*b* via a port 175*b*. Whilst a number of these opposing forces cancel each other out, the larger cross-sectional area of the first floating piston 167*b* compared to the cross-sectional area of the second floating piston 190 urges the pistons in an upwards direction. This additional force caused by the larger diameter piston 167*b* is not balanced by the opposite side 177*b* of the piston 167*b* because of the reduced pressure in the underbalance chamber 172*b*. Thus a net force results causing the two pistons 167*b* and 190 and connecting rod 174*b* to move upwards (as drawn) thus expelling fluid from the fluid container 178*b* into the surrounding portion of the well via the port 161*b*.

The 160*b* apparatus may also be controlled by a latch rather than the controllable valve, as described with respect to the FIG. 1*a* embodiment.

The diameter of the rod may be the same as the diameter of the second floating piston. In some embodiments, the downhole apparatus 160*a* and/or 160*b* may be used as an annular tool.

Various options are also available. For example, a pressure gauge can monitor the pressure within the containers and a choke can be provided at the port 161*a*, 161*b* to control fluid egress.

In alternative embodiments, the rod may be prevented from moving by a latch mechanism and a latch member instead of a control valve 162*b*, as described in FIG. 1*b*. For such embodiments, a check valve can be provided at the port 161*b*.

Figure 2B:
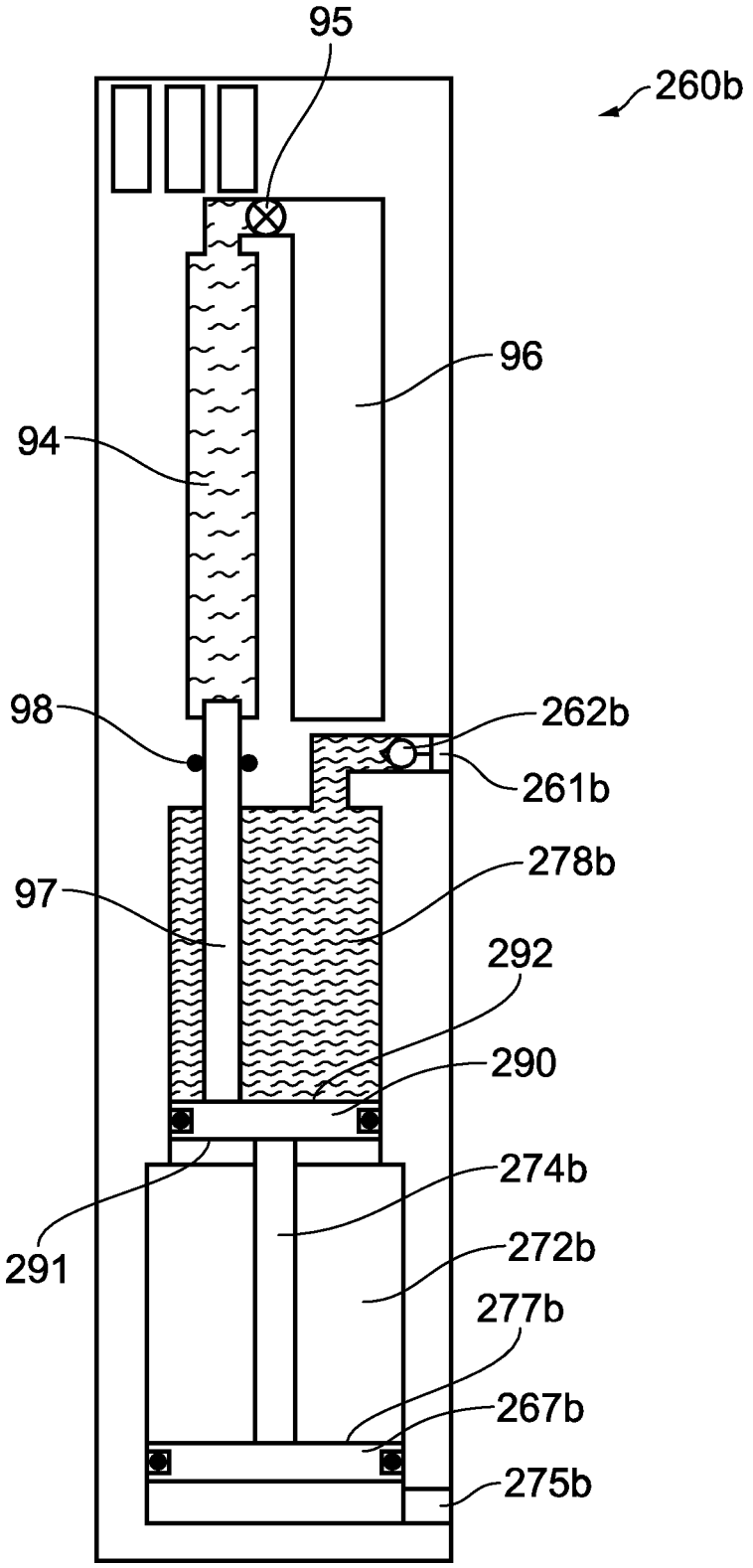

FIG. 2*b* shows a further embodiment which includes like parts with the FIG. 2*a* embodiment and these are not described again in detail. The reference numerals of the like parts share the same latter digits in both embodiments, but differ in that they are prefixed with a '2' in this embodiment instead of a '1'

In common with the FIG. 2*a* embodiment, the FIG. 2*b* embodiment 260*b* includes a fluid container 278*b* and an underbalance chamber 272*b*. A first floating piston 267*b*, a second floating piston 290 and a control rod 274*b* (connected to the upper side 277*b* of the first floating piston 267*b* and the lower side 291 of the second floating piston) are provided and all move together when appropriate forces are applied. Still in common with the FIG. 2*a* embodiment, the different cross sectional areas for the pistons 267*b* & 290, a port 275*b* below the first piston 267*b*, and the reduced pressure in the underbalance chamber 272*b* all serve to bias the pistons 267*b* & 290 and control rod 274*b* upwards. In the absence of other forces, fluid is then expelled from the fluid container 278*b* via a second port 261*b* when the pistons 267*b*, 290 and control rod 274*b* move in such an upwards direction.

In contrast to the FIG. 2*a* embodiment, a valve 262*b* at the second port 261*b* is a check valve. The movement of the pistons 267*b*, 290 and control rod 274*b* is instead controlled by a controllable valve 95 between a control chamber 94 and a dump chamber 96.

A second control rod 97 extends from an upper side 292 of the second floating piston 290, through a seal 98 into the control chamber 94. A control fluid, such as oil, is present therein. Thus when the controllable valve 95 is closed, the control fluid and valve 95 resist movement of the control rod 97 and connected floating piston 290. Consequently no fluid is expelled from the fluid container 278*b* into the surrounding portion of the well.

When the controllable valve 95 is opened, the bias to move the pistons 267*b*, 290 upwards drives the control rod 97 upwards into the control chamber 94 displacing control fluid therefrom into the dump chamber 96. Meantime, the connected floating piston 290 expels fluid from the fluid container 278*b* into the surrounding portion of the well.

In this way, the expulsion of fluids can be controlled by a valve which is not at the port. A similar control arrangement may be provided for the FIG. 1*a* embodiment.

In a modified embodiment, the seal 98 moves with the rod 97 within the container 94.

For brevity, many internal features of the apparatus 160*a*, 160*b*, 260*b* described above are not repeated or illustrated again, in the following figures.

The apparatus described in earlier embodiments will also normally include fill ports and bleed ports which are not shown for clarity.

Figure 3:
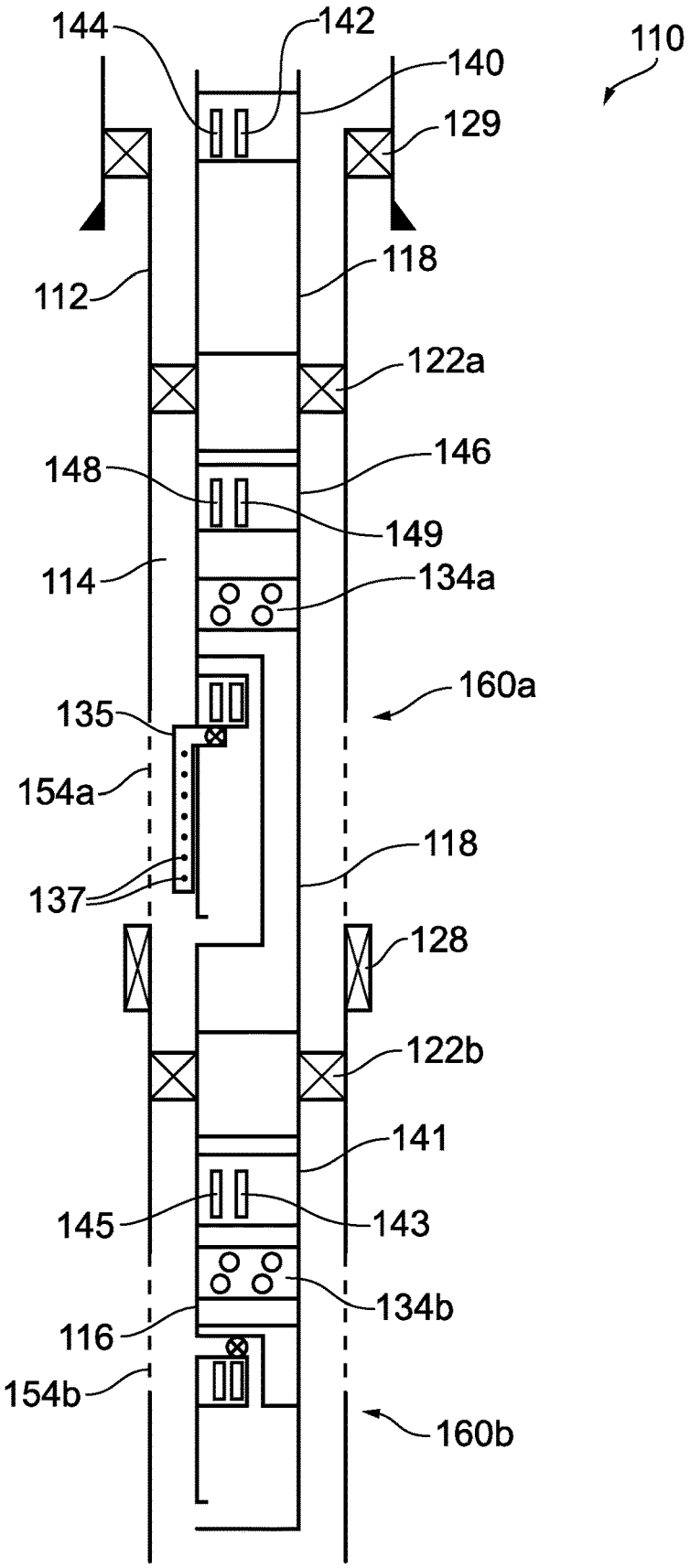
FIG. 3 is a schematic view of a well with multiple zones, illustrating a method and apparatus in accordance with one aspect of the present invention.

FIG. 3 shows a multi-zone well 114 comprising a liner hanger 129 and a liner 112 with the two apparatus 160*a* and 160*b* illustrated therein and the features of the well will first be described.

The well 114 has its own well apparatus 110 which comprises two annular sealing devices, having packer elements 122*a* & 122*b*, which split the well into a plurality of sections with adjacent zones. A first, upper, section comprises the upper packer element 122*a*, a wirelessly controlled upper sleeve valve 134*a*, the upper apparatus 160*a* and the upper slotted liner 154*a*. A second, lower, section comprises the lower packer element 122*b*, wirelessly controlled lower sleeve valve 134*b*, the lower apparatus 160*b* and a lower slotted liner 154*b*.

The slotted liners 154*a*, 154*b* create communication paths between the inside of the liner 112 and the adjacent formation. Isolating the sections from each other provides useful functionality for manipulating each adjacent zone individually though this is not an essential feature of the invention.

Instrument carriers 140, 141 and 146 are provided in each section. Each instrument carrier comprises a pressure sensor 142, 143, and 148 respectively, and a wireless relay 144, 145, and 149 respectively.

The well 114 further comprises a packer such as a swell packer 128 between an outer surface of the liner 112 and a surrounding portion of the formation. The upper tubular 118 and lower tubular 116 are continuous and connected via the upper packer element 122*a* and the lower packer element 122*b*. Portions of the upper tubular 118 and lower tubular 116 thus serve as connectors to connect the upper apparatus 160*a* and lower apparatus 160*a* to the packer elements 122*a*, 122*b* respectively.

In use, the well 114 flows through the lower slotted liner 154*b* and into the lower tubular 116 via the lower sleeve valve 134*b*. The flow continues through the lower tubular 116 past the lower packer element 122*b*, the upper apparatus 160*a* and instrument carrier 146 before continuing through the upper tubular 118 towards the surface. The upper apparatus 160*a* (in contrast to the lower apparatus 160*b*) does not take up the full bore of the upper tubular 118 and so fluid can flow therepast from below without being diverted outside of the upper tubular 118.

From an upper zone, the well flows through the slotted liner 154*a* and into the upper tubular 118 via the sleeve valve 134*a*. The flow continues through the upper tubular 118, through the upper packer element 122*a* towards the surface.

In use, the flow may be from the upper zone adjacent the well 114 only, the lower zone adjacent the well 114 only, or may be co-mingled, that is produced from the two zones simultaneously. For example, fluids from the slotted liner 154*b* can combine with further fluids entering the well 114 via the upper slotted liner 154*a* to form a co-mingled flow.

The apparatus 160*a* or 160*b* may be activated prior to flowing the well, or after flowing the well. A EM or acoustic signal is sent from a controller (not shown) and, as described above, the valve member opens to expel fluid into the surrounding portion of the well.

The apparatus 160*a* is particularly suited to deploying acid for an acid treatment, as it can distribute the fluid over the slotted liner 154*a* via openings 137 in a tube 135. The apparatus 160*b* can be used for tracer discharge for example.

The two apparatus 160*a*, 160*b* illustrated in FIG. 3 can be used independent of each other in single or multiple zone wells and are illustrated in the same figure and same well for brevity.

Figure 4:
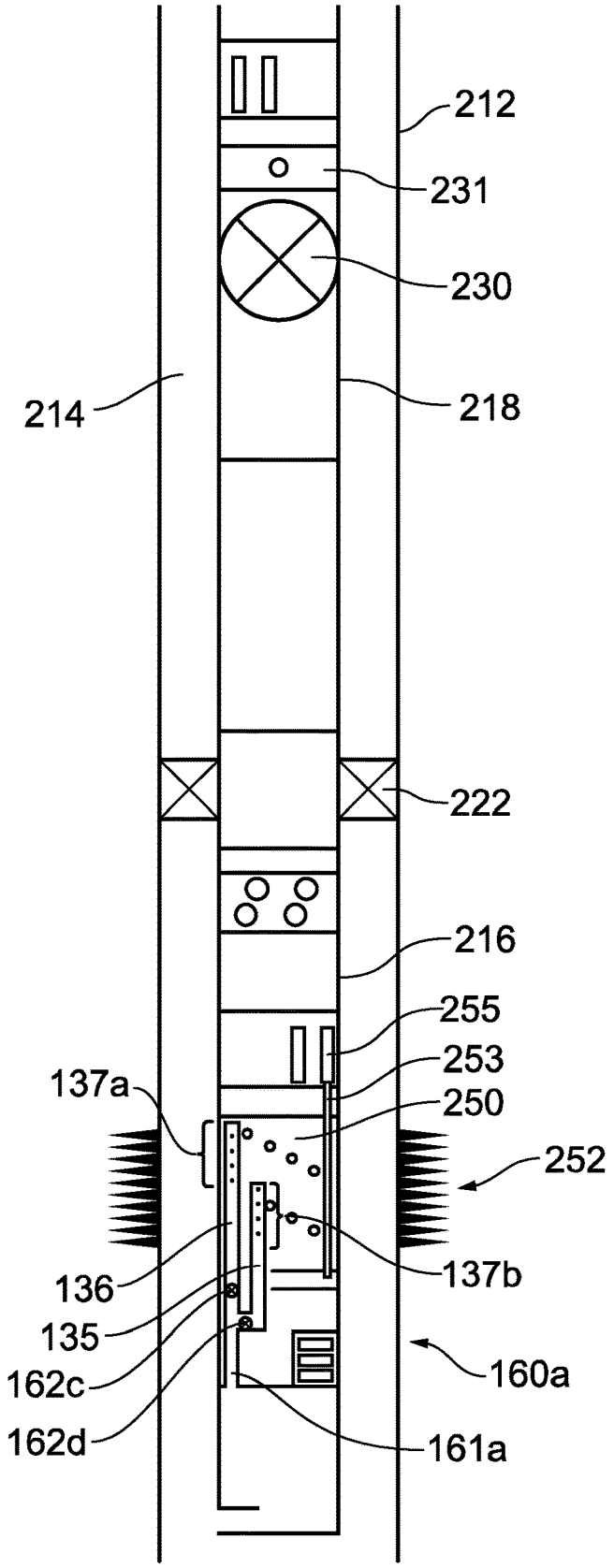
FIG. 4 is a schematic view of a well illustrating a method and apparatus in accordance with another aspect of the present invention.

FIG. 4 illustrates another method of the present invention for use during a drill stem testing (DST) operation. Above the packer element 222 a conventional tester valve 230, and circulating valve 231 are provided.

Below the packer element 222, there is provided an apparatus 160*a* described above.

The apparatus 160*a* is provided below a perforating gun 250. Two outlet tubes 135, 136 extend from opening 161*a* of the apparatus 160*a* over the perforating gun 250. The tubes 135, 136 can have multiple outlets 137*a*, 137*b*, as shown, through which fluid can be released onto the adjacent perforations 252, and/or a single outlet, for example to deploy a tracer. The tubing 216 and perforating gun 250 serve as a connector to connect the apparatus 160*a* to the annular sealing device 222.

A discrete temperature array 253 is provided adjacent to the perforations 252 and connected to a controller 255. In this embodiment the discrete temperature array has multiple discrete temperature sensors along the length of a small diameter tube which measures the temperature across the interval before during and after expulsion of fluids. This can be beneficial in determining the effectiveness of the fluid treatment.

The outlet tubes 135, 136 are controlled by individual valves 162*c*, 162*d*. The apparatus 160*a* is activated by an EM or acoustic signal and the valves 162*c*, 162*d* open, expelling fluids, such as acid or tracer, over the perforation interval. Thus, the acid can be more accurately be deployed where it is required to go. This is particularly useful when combined with the discrete temperature array described above since this can provide much better data on where the perforations (or other area) require the acid or other well/reservoir treatment. Data from the pressure sensor(s) can be transmitted wirelessly, for example by acoustic or electromagnetic signals, to the surface for monitoring purposes.

An acid treatment can be deployed in such a fashion. The acid can be deployed from the apparatus 160*a* to function as an acid wash and then optionally pressure in the well can be increased by conventional means to "inject" the acid into the formation.

Such embodiments can save the time and expense of pumping acid from the surface.

Figure 5:
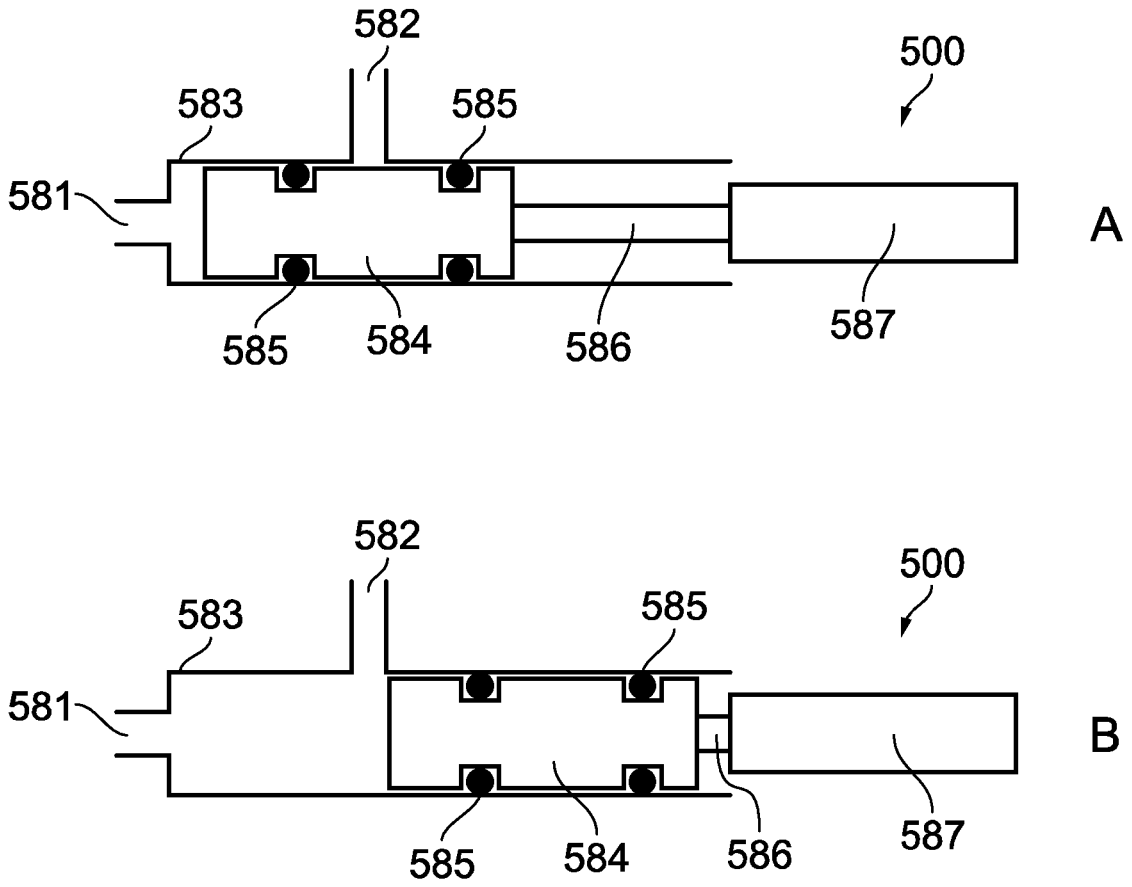
FIG. 5 is a front view of an embodiment of a valve assembly for use with the various apparatus of the present invention.

A variety of controllable valves for the ports or internal valve may be used with the apparatus described herein. FIG. 5 shows one example of a valve assembly 500 in a closed position A and in an open position B. The valve assembly 500 comprises a housing 583, a first inlet port 581, a second outlet port 582 and a valve member in the form of a piston 584. The valve assembly further comprises an actuator mechanism which comprises a lead screw 586 and a motor 587.

The first port 581 is on a first side of the housing 583 and the second port 582 is on a second side of the housing 583, such that the first port 581 is at 90 degrees to the second port 582.

The piston 584 is contained within the housing 583. Seals 585 are provided between the piston 584 and an inner wall of the housing 583 to isolate the first port 581 from the second port 582 when the valve assembly 500 is in the closed position A; and also to isolate the ports 581, 582 from the actuator mechanism 586, 587 when the valve assembly is in the closed A and/or open B position.

The piston 584 has a threaded bore on the side nearest the motor 587 which extends substantially into the piston 584, but does not extend all the way through the piston 584. The lead screw 586 is inserted into the threaded bore in the piston 584. The lead screw 586 extends partially into the piston 584 when the valve assembly 500 is in the closed position A. The lead screw 586 extends substantially into the piston 584 when the valve assembly is in the open position B.

In use, the valve assembly is initially in the closed position A. A side of the piston 584 is adjacent to the first port 581 and a top side of the piston 584 is adjacent to the second port 582 so that the first port 581 is isolated from the second port 582. This prevents fluid flow between the first port 581 and the second port 582. Once the actuator mechanism receives a signal instructing it to open the valve, the motor begins to turn the lead screw 586 which in turn moves the piston 584 towards the motor 587. As the piston 584 moves, the lead screw 586 is inserted further into the piston 584 until one side of the piston 584 is adjacent to the motor 587. In this position, the first port 581 and the second port 582 are open and fluid can flow in through the first port 581 and out through the second port 582.

Modifications and improvements can be incorporated herein without departing from the scope of the invention. For example various arrangements of the container and electronics may be used, such as electronics provided in the apparatus below the container.

Moreover, chokes can be provided functioning as reduced diameter chokes, or other forms of chokes can be utilised, for example having an extended section.

The orientation of components in a well can often be changed and wells themselves can be horizontal or at an angle. Thus relative terms such as 'above' and 'below' should not be construed as essential.

That claimed is:

1. A method to deliver a fluid into a well below an annular sealing device positioned in the well, the annular sealing device engaging with an inner face of one of a casing and a wellbore in the well and being at least 100 meters (m) below a surface of the well, the method comprising:

deploying downhole on a tubular string, a fluid expelling apparatus to expel fluid into the well when positioned at least 100 m below the well surface, the fluid expelling apparatus comprising:

a container defining a void having a volume of at least 1 litre (l);

a floating piston having a first dynamic seal and adapted to move within the container;

a first portion of the container in contact with the first dynamic seal, the first dynamic seal defining a first cross-sectional area, and a second portion of the container in contact with a second dynamic seal, the second dynamic seal defining a second, smaller, cross-sectional area; said first and second cross-sectional areas being in planes substantially parallel to a main plane of the floating piston;

the first dynamic seal being between the floating piston and said first portion of the container, such that a first section of the void on one side of the floating piston is isolated from a second section of the void on a second opposite side of the floating piston;

a first member abutting with the floating piston on said second side, such that the first member moves with the floating piston and is received within the second cross-sectional area defined by the second dynamic seal;

the second dynamic seal being between the first member and said second portion of the container, such that said second section of the void, being on one side of the second dynamic seal, is isolated from a third section of the void, on an opposite side of the second dynamic seal;

a first port in the container between the first section of the void and an outside of the container;

a second port in the container between at least one of the second and third sections of the void and an outside of the container, for expelling fluid therefrom in use;

an electronic control mechanism comprising an electronic communication device configured to receive a control signal to activate a piston control device, wherein the electronic communication device is a wireless communication device configured to receive a wireless control signal in one or more of an electromagnetic form and an acoustic form as the control signal;

the piston control device operable to one of directly and indirectly control movement of the floating piston, and the piston control device comprising at least one of:

(i) a controllable mechanical valve assembly having a valve member adapted to move in response to a signal received from the electronic communication device to one of selectively allow and selectively resist fluid passage via one or more of the first and second ports; and, (ii) a controllable latch mechanism;

providing the fluid in one of the second and third sections of the void; then, running the fluid expelling apparatus into the well to a position for the fluid expelling apparatus to deliver the fluid below the annular sealing device;

after running the fluid expelling apparatus into the well, the pressure in the other of the second and third sections of the void being less than a surrounding portion of the well;

sending the wireless control signal to the electronic communication device; activating the piston control device to move the floating piston and the first member; and expelling the fluid from said one of the second and third sections of the void where fluid is provided, into the well through the second port, below the annular sealing device.

2. A method as claimed in claim 1, wherein a mechanical valve assembly is provided at the second port configured to resist fluid flow through the second port in a closed position and allow fluid flow through the second port in an open position.

3. A method as claimed in claim 2, wherein the controllable mechanical valve assembly is at one of the first and second ports.

4. A method as claimed in claim 2, wherein the piston control device comprises the controllable mechanical valve assembly and wherein the controllable mechanical valve assembly comprises said mechanical valve assembly at the second port.

5. A method as claimed in claim 2, wherein the mechanical valve assembly at the second port comprises a check valve.

6. A method as claimed in claim 1, wherein the fluid expelling apparatus comprises a choke.

7. A method as claimed in claim 6, wherein the choke comprises one of fixed and adjustable.

8. A method as claimed in claim 1, wherein the fluid expelling apparatus is configured to expel at least 11 of fluid from the container into the well when positioned below 100 m.

9. A method as claimed in claim 8, wherein the fluid expelling apparatus is configured to expel at least 5 l of fluid from the container into the well when positioned below 100 m.

10. A method as claimed in claim 8, wherein the fluid expelling apparatus is configured to expel at least 10 l of fluid from the container into the well when positioned below 100 m.

11. A method as claimed in claim 8, wherein the fluid expelling apparatus is configured to expel at least 50 l of fluid from the container into the well when positioned below 100 m.

12. A method as claimed in claim 1, wherein a bypass bore extends through the container, said bore sealed from each section of the void.

13. A method as claimed in claim 1, wherein the second port is between the second section of the void and the outside of the container.

14. A method as claimed in claim 1, wherein the second port is between the third section of the void and the outside of the container.

15. A method as claimed in claim 1, wherein the valve member moves to one of an original position and moves to a further position.

16. A method as claimed in claim 15, wherein the valve member moves to the one of the original position and moves to the further position in response to a further control signal received by the electronic communication device.

17. A method as claimed in claim 1, wherein the fluid delivered by the fluid expelling apparatus comprises one or more of a breaker fluid, tracer, acid treatment, chemical barrier and precursors to a chemical barrier.

18. A method as claimed in claim 1, wherein the first port and second port are in communication with respective surrounding portions of the well, the surrounding portions of the well being isolated from each other.

19. A method as claimed in claim 18, wherein the annular sealing device is a first annular sealing device, and a second annular sealing device is provided in the well, and wherein the second port of the fluid expelling apparatus is provided in an isolated region of the well below the first annular sealing device and above the second annular sealing device, and the first port of the fluid expelling apparatus is provided in one of a region of the well above the first annular sealing device and a region of the well below the second annular sealing device, and wherein there is a communication path between the well and a surrounding formation, between the first and second annular sealing devices.

20. A method as claimed in claim 18, wherein the annular sealing device is a first annular sealing device, and a second annular sealing device is provided in the well, and wherein the second port of the fluid expelling apparatus is provided in an isolated region of the well below the first annular sealing device and above the second annular sealing device, and the first port of the fluid expelling apparatus is provided in one of a region of the well above the first annular sealing device and a region of the well below the second annular sealing device, and wherein there is no communication path in the well between the two annular sealing devices and a surrounding formation.

* * * * *